US012325923B2

(12) United States Patent
Fujinuma

(10) Patent No.: US 12,325,923 B2
(45) Date of Patent: Jun. 10, 2025

(54) ELECTROCHEMICAL CELL AND METHOD OF PRODUCING CARBONYL COMPOUND

(71) Applicant: SEKISUI CHEMICAL CO., LTD., Osaka (JP)

(72) Inventor: Naohiro Fujinuma, Tsukuba (JP)

(73) Assignee: SEKISUI CHEMICAL CO., LTD., Osaka (JP)

( * ) Notice: Subject to any disclaimer, the term of this patent is extended or adjusted under 35 U.S.C. 154(b) by 6 days.

(21) Appl. No.: 18/107,622

(22) Filed: Feb. 9, 2023

(65) Prior Publication Data

US 2023/0279561 A1 Sep. 7, 2023

Related U.S. Application Data

(60) Provisional application No. 63/308,595, filed on Feb. 10, 2022.

(51) Int. Cl.

| | |
|---|---|
| ***C25B 3/07*** | (2021.01) |
| ***C25B 1/23*** | (2021.01) |
| ***C25B 3/23*** | (2021.01) |
| ***C25B 9/17*** | (2021.01) |
| ***C25B 11/052*** | (2021.01) |
| ***C25B 11/081*** | (2021.01) |
| ***C25B 11/095*** | (2021.01) |

(52) U.S. Cl.

CPC ..... *C25B 3/07* (2021.01); *C25B 1/23* (2021.01); *C25B 3/23* (2021.01); *C25B 9/17* (2021.01); *C25B 11/052* (2021.01); *C25B 11/081* (2021.01); *C25B 11/095* (2021.01)

(58) Field of Classification Search

CPC .... C25B 3/07; C25B 3/26; C25B 1/23; C25B 3/23; C25B 9/17; C25B 11/052; C25B 11/081; C25B 11/095; C25B 3/20; C25B 11/065; C25B 11/085

See application file for complete search history.

(56) References Cited

U.S. PATENT DOCUMENTS

| | | | | |
|---|---|---|---|---|
| 5,296,106 | A * | 3/1994 | Rolison | B01J 35/33 205/334 |
| 2014/0072836 | A1* | 3/2014 | Mills | H01M 14/00 429/422 |
| 2016/0138176 | A1* | 5/2016 | Yoo | C25B 11/075 204/239 |
| 2017/0130347 | A1* | 5/2017 | Rosenthal | C25B 11/057 |
| 2019/0292668 | A1 | 9/2019 | Fujinuma | |

(Continued)

FOREIGN PATENT DOCUMENTS

| | | |
|---|---|---|
| WO | 2019/182164 | 9/2019 |

OTHER PUBLICATIONS

Jensen et al. Scalable carbon dioxide electroreduction coupled to carbonylation chemistry. Nature Communications, 8:489. Sep. 8, 2017. (Year: 2017).*

(Continued)

*Primary Examiner* — Ciel P Contreras

(74) *Attorney, Agent, or Firm* — Wenderoth, Lind & Ponack, L.L.P.

(57) ABSTRACT

An electrochemical cell includes: a cathode having a first catalyst that reduces carbon dioxide to carbon monoxide; an anode; an electrolyte solution containing a reactant and an electrolyte; and a second catalyst that synthesizes a carbonyl compound from the carbon monoxide and the reactant.

18 Claims, 1 Drawing Sheet

(56) References Cited

U.S. PATENT DOCUMENTS

| | | | | |
|---|---|---|---|---|
| 2020/0095692 | A1* | 3/2020 | Fujinuma | C25B 1/00 |
| 2022/0062864 | A1* | 3/2022 | Liu | C25B 11/091 |
| 2023/0099785 | A1* | 3/2023 | Atanassov | C25B 11/054<br>205/440 |

OTHER PUBLICATIONS

Fujinuma et al. Highly Efficient Electrochemical CO2 Reduction Reaction to CO with One-Pot Synthesized Co-Pyridine-Derived Catalyst Incorporated in a Nafion-Based Membrane Electrode Assembly. Advanced Energy Materials. 2020. 10, 2001645. Aug. 11, 2020. (Year: 2020).*

* cited by examiner

ELECTROCHEMICAL CELL AND METHOD OF PRODUCING CARBONYL COMPOUND

FIELD OF THE INVENTION

The present invention relates to an electrochemical cell that produces a carbonyl compound by using carbon dioxide as a raw material, and a method of producing the carbonyl compound.

BACKGROUND OF THE INVENTION

Electrochemical synthesis methods are attracting attention in recent years, because the methods do not need to use highly toxic substrates or highly explosive gases mixed with oxygen, and can directly utilize electricity obtained from renewable energy. Furthermore, in recent years, it has been studied to produce organic substances by an electrochemical reaction using carbon dioxide, carbon monoxide obtained by the reduction of carbon dioxide, or the like, as a raw material, for the purpose of suppressing global warming and replacing fossil fuels.

Carbonyl compounds such as organic carbonates have been used in various fields such as paints, adhesives, electrolyte solutions and raw materials for resins, and in recent years, it has been attempted to electrochemically synthesize the carbonyl compounds by using carbon dioxide as a raw material and using various catalysts.

For example, Patent Document 1 discloses an electrochemical cell including: a first electrochemical compartment provided with a first electrode; a second electrochemical compartment provided with a second electrode and containing an electrolytic substrate; an ion conducting membrane that partitions the first electrochemical compartment from the second electrochemical compartment; and a connecting path that connects the first electrochemical compartment and the second electrochemical compartment. The electrochemical cell of Patent Document 1 reduces carbon dioxide to carbon monoxide on the first electrode, and causes the generated carbon monoxide to flow out to the second electrochemical compartment through a connecting pipe; and produces a valuable substance such as an organic carbonate, from carbon monoxide and an electrolyte solution on the second electrode.

CITATION LIST

Patent Literature

[Patent Document 1] WO 2019/182164

SUMMARY OF THE INVENTION

Technical Problem

However, in a method for producing a carbonyl compound such as an organic carbonate with the use of a conventional electrochemical cell, a structure of the electrochemical cell becomes complicated, and further improvement is required for practical application.

Then, an object of the present invention is to provide an electrochemical cell that can electrochemically synthesize a carbonyl compound from carbon dioxide by an apparatus having a relatively simple structure, and a method for producing the carbonyl compound by use of the electrochemical cell.

Solution to Problem

The present invention provides the following [1] to [14].

[1] An electrochemical cell including: a cathode having a first catalyst that reduces carbon dioxide to carbon monoxide; an anode; an electrolyte solution containing a reactant and an electrolyte; and a second catalyst that synthesizes a carbonyl compound from the carbon monoxide and the reactant.

[2] The electrochemical cell according to the above [1], wherein the electrolyte includes a redox ion; the anodic electrode converts the redox ion into an oxidizing species; and the second catalyst synthesizes the carbonyl compound from the carbon monoxide and the reactant in the presence of the oxidizing species.

[3] The electrochemical cell according to the above [2], wherein the redox ion is a halogen ion.

[5] The electrochemical cell according to any one of the above [1] to [3], wherein the second catalyst includes a metal element selected from the group consisting of elements of Group 8 to Group 11.

[5] The electrochemical cell according to any one of the above [1] to [4], wherein the second catalyst includes Pd.

[6] The electrochemical cell according to any one of the above [1] to [5], wherein the anode includes an electrode substrate, and the second catalyst is supported on the electrode substrate.

[7] The electrochemical cell according to any one of the above [1] to [6], further including a catalyst-supporting substrate that supports the second catalyst.

[8] The electrochemical cell according to any one of the above [1] to [7], wherein the second catalyst is contained in the electrolyte solution.

[9] The electrochemical cell according to any one of the above [1] to [8], wherein the second catalyst is arranged between the cathode and the anode.

[10] The electrochemical cell according to any one of the above [1] to [9], wherein the first catalyst includes a metal element of the Group 7 to Group 12.

[11] The electrochemical cell according to any one of the above [1] to [10], wherein the first catalyst includes CoO and a component derived from a pyridine derivative.

[12] The electrochemical cell according to any one of the above [1] to [11], wherein the electrochemical cell is a single-compartment type, and the electrolyte solution filled in the electrolytic compartment of the electrochemical cell comes in contact with the cathode, the anode and the second catalyst at least.

[13] The electrochemical cell according to any one of the above [1] to [12], wherein the reactant is an alcohol-based compound.

[14] A method of producing a carbonyl compound by synthesizing the carbonyl compound from carbon dioxide, in an electrochemical cell, the electrochemical cell including a cathode having a first catalyst, an anode, an electrolyte solution containing a reactant and an electrolyte, and a second catalyst, the method including converting the carbon dioxide into carbon monoxide by the first catalyst, and synthesizing the carbonyl compound from the carbon monoxide and the reactant by the second catalyst.

Advantageous Effects of Invention

In the present invention, the carbonyl compound can be electrochemically synthesized from carbon dioxide by an apparatus having a relatively simple structure.

DETAILED DESCRIPTION OF THE INVENTION

Figure 1:
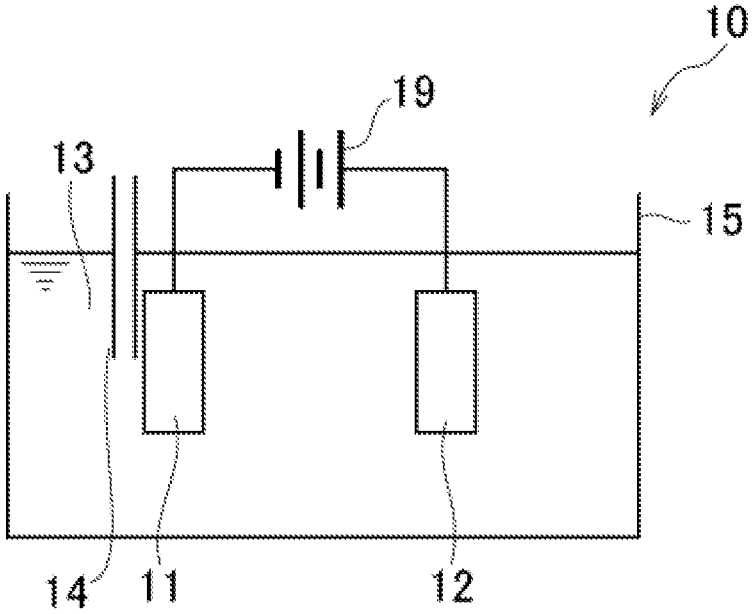
FIG. 1 shows a schematic view showing an electrochemical cell according to first and second embodiments of the present invention.

The electrochemical cell and the method of producing the carbonyl compound of the present invention will be described below with reference to the embodiments.

First Embodiment

An electrochemical cell 10 according to the first embodiment of the present invention includes a cathode 11, an anode 12, and an electrolyte solution 13. The electrolyte solution 13 includes a reactant and an electrolyte, and is filled in the inside of the electrochemical cell 10.

A voltage is applied between the cathode 11 and the anode 12 by a power source 19. When a voltage is applied, as will be described later, a reduction reaction in which carbon dioxide is reduced to carbon monoxide occurs on a cathode 11 side, and also a redox species is converted into an oxidizing species on an anode 12 side; and the oxidizing species and a second catalyst cause an electrochemical reaction in which the carbon monoxide is converted into a carbonyl compound in the electrolyte solution 13.

The electrochemical cell 10 according to the first embodiment includes a first catalyst that reduces the carbon dioxide to the carbon monoxide, and a second catalyst that synthesizes the carbonyl compound from the carbon monoxide and the reactant, in the presence of the oxidizing species.

In the electrochemical cell 10, the first catalyst is contained in the cathode 11, and the second catalyst is contained in the electrolyte solution 13. In the present embodiment, a redox species is used as the electrolyte of the electrolyte solution 13. In other words, the electrolyte contains redox ions derived from the redox species.

The electrochemical cell 10 in the present embodiment is a single-compartment type of electrochemical cell. More specifically, the electrochemical cell 10 is not partitioned into an anode compartment and a cathode compartment by an ion exchange membrane or the like, but is composed of a single electrolytic compartment 15; and both of the cathode 11 and the anode 12 are provided in the electrolytic compartment 15, and the electrolytic compartment 15 is filled with an electrolyte solution 13. Due to such a configuration, the electrolyte solution 13 at least comes into contact with the cathode 11, the anode 12 and the second catalyst.

The cathode 11 and the anode 12 are generally arranged in the electrolyte solution 13 which is filled in the electrolytic compartment 15, as are shown in FIG. 1, but may be arranged in any manner as long as the cathode and the anode come in contact with the electrolyte solution 13.

In addition, in the present embodiment, the second catalyst is contained in the electrolyte solution 13, and thereby results in being arranged between the cathode 11 and the anode 12. Because of this, it becomes easy for the reactant, the carbon monoxide generated on the cathode 11, and the oxidizing species converted on the anode 12 to come in contact with each other in the presence of the second catalyst, and it becomes easy to synthesize the carbonyl compound.

The electrochemical cell 10 has a supply port 14 provided therein which supplies carbon dioxide to the inside of the electrochemical cell 10. Through the supply port 14, the carbon dioxide is supplied into the inside of the electrochemical cell. Through the supply port 14, the carbon dioxide is supplied as a gas, into the inner part of the electrolyte solution 13. A supply path (not shown) such as a pipe is connected to the supply port 14, and a carbon dioxide source or the like (not shown) is connected to the electrochemical cell 10 via the supply path; and carbon dioxide is supplied from the carbon dioxide source or the like. A flow rate adjusting mechanism or the like may be provided in the supply path, and adjust a flow rate of the carbon dioxide or the like to be supplied.

The carbon dioxide may be continuously supplied to the electrochemical cell 10, or may be intermittently supplied. The carbon dioxide may be supplied to the electrochemical cell 10 in a form of carbon dioxide alone, or may be supplied to the electrochemical cell 10, while using an inert gas such as helium as a carrier gas.

The supply port 14 may be arranged in the electrolyte solution 13, and the carbon dioxide may be supplied to the electrolyte solution 13 from the supply port 14 by bubbling or the like. The supply port 14 may be arranged at a position proximate to the cathode 11 so that the carbon dioxide is efficiently reduced on the cathode 11, and the cathode 11 may be arranged at least at a position closer to the supply port 14 than the anode 12.

In the present embodiment, the carbon dioxide is supplied from the supply port 14 to the inside of the electrochemical cell 10, and is reduced by the first catalyst on the cathode 11; and carbon monoxide is generated. The generated carbon monoxide preferably diffuses into the electrolyte solution 13.

Meanwhile, the anode 12 converts the redox ion from a reducing species to an oxidizing species. Then, the second catalyst in the electrolyte solution 13 synthesizes a carbonyl compound from the carbon monoxide and the reactant in the presence of the oxidizing species.

The electrochemical cell 10 may cause the electrolyte solution to flow by providing a stirring apparatus such as a stirring blade in the inside of the electrochemical cell 10 (specifically, in the inside of the electrolytic compartment 15) for stirring; or by providing a circulation path of which both the outlet side and the inlet side are connected to the electrolytic compartment 15, and circulating the electrolyte solution through the circulation path. When the electrolyte solution 13 is stirred or caused to flow, it becomes easy to diffuse the carbon monoxide generated on the cathode into the electrolyte solution 13. In some cases, the second catalyst in the electrolyte solution 13 is not dissolved in the electrolyte solution, but even in such a case, similarly, it becomes easy to uniformly disperse the second catalyst in the electrolyte solution 13. Accordingly, it becomes easy to bring the carbon monoxide generated on the cathode into contact with the reactant, the second catalyst, and the oxidizing species of the redox species, and to enhance the reaction efficiency.

In addition, as the synthesis of the carbonyl compound progresses in the electrochemical cell 10, the amount of the generated carbonyl compound increases in the electrolyte solution 13, and accordingly, the generated carbonyl compound may be collected by extracting a part or all of the electrolyte solution 13 from the electrochemical cell 10.

Components used in the present embodiment will be described in more detail below.

[Cathode]

As described above, the cathode 11 is arranged in the inside of the electrolytic compartment 15 of the electrochemical cell 10, and includes a first catalyst.

(First Catalyst)

The first catalyst is a reducing catalyst which is capable of reducing carbon dioxide to carbon monoxide. The reducing catalyst (first catalyst) contained in the cathode 11 is not particularly limited as long as the reducing catalyst is a catalyst which is capable of reducing carbon dioxide to carbon monoxide. For example, it is preferable that the reducing catalyst contain a metal element; and the metal element may be a metal itself, or also a metal compound or the like.

Examples of the metal element in the above metals are not particularly limited, but include V, Cr, Mn, Fe, Co, Ni, Cu, Sn, Zr, Nb, Mo, Ru, Rh, Pd, Ag, Cd, Hf, Ta, W, Re, Ir, Pt, Au, Hg, Al, Si, In, Sn, Tl, Pb, Bi, Sb, Te, U, Sm, Tb, La, Ce, Zn, Os and Nd.

As the above metal compound, metal compounds such as inorganic metal compounds and organic metal compounds of these metals can be used; and specific examples thereof include metal halides, metal oxides, metal hydroxides, metal nitrates, metal sulfates, metal acetates, metal phosphates, metal carbonyls and metal acetylacetonates.

A metal element used in the first catalyst is preferably a metal element in Group 7 to Group 12. Preferable specific examples include Mn, Fe, Ni, Ru, Co, Rh, Cu, Zn, Ag, Au, Pd, Ir, Pt and Os; and among them, Co, Fe, Ni, Au and Ag are more preferable, and Co is particularly preferable. When these metal elements are used, it becomes easy to enhance the conversion efficiency from carbon dioxide to the carbon monoxide, and the catalytic activity becomes high. The metals which are used in the metal derivatives may be used singly, or two or more types thereof may be used in combination.

The first catalyst may contain a carbon compound in addition to the above metal or metal compound. As the carbon compound, an electroconductive carbon compound is preferable. More specifically, examples of the carbon compound include mesoporous carbon, activated carbon, carbon black such as Ketjhen Black and acetylene black, graphite, carbon fibers, graphene and carbon nanotubes; and among them, carbon black is preferable, and in the carbon black, the electroconductive carbon black is further preferable. In addition, it is preferable that the carbon compound be porous carbon.

When the first catalyst contains a carbon compound, the metal or metal compound may be supported on the carbon compound. In addition, the carbon compound may be mixed with a complex or the like, which contains the above metal element, and be heat-treated; and thereby be formed into a catalyst powder or the like.

<<Nitrogen-Containing Metal Catalyst>>

It is also preferable that the first catalyst be a catalyst which contain a nitrogen element and a metal element (also referred to as a "nitrogen-containing metal catalyst"). Here, it is preferable that the nitrogen element which is used in the nitrogen-containing metal catalyst be derived from a nitrogen-containing compound which will be described later. In addition, specific examples of the metal element used in the nitrogen-containing metal catalyst are as described above, and suitable metal elements thereof are also as described above. When the nitrogen-containing metal catalyst is used, the production efficiency of the carbon monoxide becomes high, and thereby the selectivity of the carbonyl compound to be synthesized also becomes high.

The nitrogen-containing metal catalyst may be a catalyst obtained by the heat treatment of a mixture containing a metal derivative and a nitrogen-containing compound (hereinafter referred to as a "raw material mixture for first catalyst"), and specifically, preferable is a catalyst obtained by the heat treatment of the raw material mixture for first catalyst containing a metal derivative, a nitrogen-containing compound, and a carbon compound. The heat treatment is typically sintering.

The nitrogen-containing metal catalyst may be produced by the heat treatment of the raw material mixture for first catalyst so that a bond between metal and nitrogen elements, which is derived from the metal derivative and the nitrogen-containing compound, is formed in the catalyst. In addition, the carbon compound functions as a support in the catalyst, and components derived from the metal derivative and the nitrogen-containing compound are supported on the carbon compound. The nitrogen-containing metal catalyst having the structure described above efficiently reduces carbon dioxide to carbon monoxide, and its conversion efficiency becomes high.

The metal element in the metal derivative is as described above. It is preferable that the metal derivative contain a metal ion. In addition, the metal derivative may be used, for example, in a form of a metal salt. Examples of the metal salt include a metal nitrate, a metal sulfate, a metal chloride, a metal bromide, a metal iodide, and a metal acetate; and among them, the metal nitrate is preferable. Preferable specific examples include cobalt nitrate ($Co(NO_3)_2$), nickel nitrate ($Ni\ NO_3)_2$), iron nitrate ($Fe(NO_3)_2$), manganese nitrate ($Mn(NO_3)_2$), copper nitrate ($Cu(NO_3)_2$), and zinc nitrate ($Zn(NO_3)_2$). The metal salts may be used singly, or two or more types thereof may be used in combination.

The content of the metal derived from the above metal derivative in the raw material mixture for first catalyst is, for example, 0.1% by mass or more and 50% by mass or less with respect to the total amount of the raw material mixture for first catalyst, but is preferably 0.1% by mass or more and 10% by mass or less. When the content is set in the above range, the metal is contained in the catalyst without being agglomerated, and an appropriate amount of the catalytic active sites is formed. Because of this, it becomes easy to enhance the efficiency of conversion to the carbon monoxide.

The above metal content is more preferably 0.5% by mass or more, is further preferably 1.0% by mass or more, and is still further preferably 1.5% by mass or more; and is more preferably 5.0% by mass or less, and further preferably 4.0% by mass or less, from the viewpoints of the conversion efficiency and the like. Here, the total amount of the raw material mixture for first catalyst means the total amount of the solids of the raw material mixture for first catalyst, and when a volatile component is blended in the raw material mixture for first catalyst in the production process, the total amount is an amount excluding the volatile component.

(Nitrogen-Containing Compound)

The nitrogen-containing compound is a compound containing nitrogen, and a component derived from the nitrogen-containing compound may form a bond such as a coordination bond with a metal element derived from the metal derivative, in a nitrogen-containing metal catalyst. Specific examples of the nitrogen-containing compound include compounds that include each a nitrogen-containing aromatic ring having a nitrogen element as a constituent element of the aromatic ring. Specific examples of the nitrogen-containing compound include a pyridine derivative, an imidazole derivative, a pyrazole derivative, and a triazole derivative. These compounds may be used singly, or two or more types thereof may be used in combination.

Among these derivatives, any one is preferable which be selected from the group consisting of a pyridine derivative, an imidazole derivative and a triazole derivative, from the viewpoints of the conversion efficiency and the like, and the pyridine derivative is particularly preferable. In other words, it is particularly preferable that the nitrogen-containing metal catalyst be a catalyst obtained by the heat treatment of a mixture which contains the metal derivative, the pyridine derivative and the carbon compound.

((Pyridine Derivative))

The pyridine derivative is a compound having a pyridine ring. The pyridine derivative may be a compound having one pyridine ring in one molecule, a compound having two pyridine rings, a compound having three pyridine rings, or a compound having four or more pyridine rings.

Examples of the compound (pyridine monomer) having one pyridine ring in one molecule include compounds which have each at least one functional group such as an amino group (—$NH_2$), an alkyl group or an alkoxy group in the pyridine ring, from the viewpoint of preventing the pyridine derivative from sublimating or evaporating at the time of the heat treatment. Examples of the alkyl group include alkyl groups having about 1 to 5 carbon atoms such as a methyl group, an ethyl group, a butyl group and a pentyl group (amyl group). Examples of the alkoxy group include alkoxy groups having about 1 to 4 carbon atoms such as a methoxy group and a butoxy group. Specific examples of the pyridine monomer include: alkylpyridines such as methylpyridine, ethylpyridine, butylpyridine, and pentylpyridine (amylpyridine); alkoxypyridines such as methoxypyridine and butoxypyridine; and aminopyridines such as 4-aminopyridine.

Among the above, the pyridine monomer is preferably aminopyridine, and is more preferably 4-aminopyridine. When the pyridine derivative is used which has an amino group such as 4-aminopyridine, it becomes easy to enhance the conversion efficiency in a case where the catalyst is used as an electrode for reducing carbon dioxide. In addition, the ethylpyridine is also preferable as the pyridine monomer.

Examples of the compound having two pyridine rings in one molecule include compounds each having a bipyridine skeleton in which two pyridine rings are directly bonded by a carbon-carbon single bond (bipyridine derivative). As the bipyridine derivative, bipyridine is preferable, and specifically, 2,2'-bipyridine is more preferable, from the viewpoint of the above conversion efficiency in a case where the bipyridine derivative is used in the electrode for reducing carbon dioxide. In addition, a bipyridine derivative having an amino group is also preferable; and specific examples thereof include diamino bipyridines, and among the diamino bipyridines, 4,4'-diamino-2,2'-bipyridine is more preferable.

Examples of the compound having three pyridine rings in one molecule include compounds (terpyridine derivative) each having a terpyridine skeleton in which three pyridine rings are directly bonded by a carbon-carbon single bond. Examples of the terpyridine derivative include terpyridine.

Examples of the compound having four or more pyridine rings in one molecule include pyridine oligomers which have each four or more pyridine rings and have a weight-average molecular weight smaller than 10,000. Examples of the pyridine oligomers include compounds each having a polypyridine skeleton in which pyridine rings are directly bonded by a carbon-carbon single bond. Suitable specific examples include polypyridine. Examples of the polypyridine include poly(2,5-pyridine) and poly(3,5-pyridine), and among the polypyridines, poly(2,5-pyridine) is more preferable from the viewpoints of the above conversion efficiency and the like in a case where the polypyridine is used in the electrode for reducing carbon dioxide.

A molecular weight of the polypyridine such as poly (2,5-pyridine) is not particularly limited, and is preferably 500 or larger and 8,000 or smaller, is preferably 1,000 or larger and 6,000 or smaller, is more preferably 1,500 or larger and 5,000 or smaller, in terms of weight-average molecular weight.

In addition, examples of the pyridine derivative include polymers which have each a plurality of pyridine rings in one molecule and have a weight-average molecular weight of 10,000 or larger. The pyridine derivative in this case may have four or more pyridine rings in one molecule. As a specific compound, polyvinyl pyridine is also preferable which is a polymer of vinyl pyridine, and specifically, poly(4-vinylpyridine) is more preferable. When the poly(4-vinylpyridine) is used, it becomes easy to enhance the conversion efficiency and the like in a case where the poly(4-vinylpyridine) is used in the electrode for reducing carbon dioxide.

It is preferable for the polyvinyl pyridine such as the poly(4-vinylpyridine) to have a molecular weight of a certain level or larger, from the viewpoints of the conversion efficiency and the like. The weight-average molecular weight is, for example, 1,000 or larger and 10,000 or larger, is preferably 30,000 or larger, and is further preferably 50,000 or larger; and in addition, the weight-average molecular weight is, for example, 200,000 or smaller, and is preferably 100,000 or smaller, from the viewpoint of ease of availability, and the like.

The weight-average molecular weight is a value which is measured by gel permeation chromatography (GPC), and polystyrene may be used as a standard substance.

Among the above, it is further preferable for the pyridine derivative to be 4-aminopyridine, 2,2'-bipyridine, poly (2,5-pyridine), and poly(4-vinylpyridine) having a weight-average molecular weight of 10,000 or larger. In addition, 4,4'-diamino-2,2'-bipyridine is also preferable.

In addition, from the viewpoint of further improving the conversion efficiency and the like, it is particularly preferable to use the poly(4-vinylpyridine) or the poly(2,5-pyridine) as the pyridine derivative among the above, and is most preferable to use the poly(4-vinylpyridine).

((Imidazole Derivative))

The imidazole derivative to be used in the active particle-containing catalyst is a compound having an imidazole ring. The imidazole derivative may be a compound having one imidazole ring in one molecule (imidazole monomer), a compound having two imidazole rings, and a compound having three imidazole rings.

Examples of the imidazole monomer include compounds each having an imidazole which has at least one functional group such as an amino group (—$NH_2$), an alkyl group, an alkoxy group, a halogen group, an aryl group or an aralkyl group, and may have a heterocyclic structure containing an imidazole ring.

Specific examples of the imidazole monomer include: 1-methylimidazole, 1-ethylimidazole, 1-propylimidazole, 1-isopropylimidazole, 1-butylimidazole, 1-phenethylimidazole; 2-methylimidazole, 2-ethylimidazole, 2-propylimidazole, 2-isopropylimidazole, 2-butylimidazole, 2-phenylimidazole; 4-methylimidazole, 4-ethylimidazole, 4-propylimidazole, 4-isopropylimidazole, 4-butylimidazole, 4-phenylimidazole; and benzimidazole, 1-methylbenzimidazole, and bifonazole.

Examples of the compound having two imidazole rings in one molecule include compounds each having an imidazole skeleton in which two imidazole rings are directly bonded by a carbon-carbon single bond (biimidazole derivative). Examples of the imidazole derivative include biimidazole.

In addition, it is preferable for the compound having a plurality of imidazole rings in one molecule to be polyvinyl imidazole which is a polymer of vinyl imidazole, is more preferable to be poly(4-vinylimidazole) and poly (N-vinyl imidazole), among the polymers, and is further preferable to be the poly(4-vinylimidazole).

It is preferable for the polyvinyl imidazole such as the poly(4-vinylimidazole) to have a molecular weight of a certain level or larger, from the viewpoints of the conversion efficiency, selectivity and the like. The weight-average molecular weight is, for example, 1,000 or larger, and is preferably 10,000 or larger; and in addition, the weight-average molecular weight is, for example, 200,000 or smaller, and is preferably 100,000 or smaller, from the viewpoint of ease of availability, and the like.

((Pyrazole Derivative))

The pyrazole derivative is a compound having a pyrazole ring. The pyrazole derivative may be a compound having one pyrazole ring in one molecule (pyrazole monomer), a compound having two pyrazole rings, and a compound having three pyrazole rings.

Examples of the pyrazole monomer include compounds each having a pyrazole ring which has at least one functional group such as an amino group $NH_2$), an alkyl group, an alkoxy group, an aryl group, or an aralkyl group. Specific examples thereof include 1-methylpyrazole, 1-ethylpyrazole, 1-propylpyrazole, 1-isopropylpyrazole, 1-butylpyrazole, 1-phenethylpyrazole, 3-methylpyrazole, 3-ethylpyrazole, 3-propylpyrazole, 3-isopropylpyrazole, 3-butylpyrazole, 3-phenylpyrazole, 1,3-dimethylpyrazole, 1,3-diethylpyrazole, 1,3-dipropylpyrazole, 1,3-isopropylpyrazole, 1,3-dibutylpyrazole and 1,3-diphenetylpyrazole.

((Triazole Derivative))

The triazole derivative is a compound having a triazole ring. The triazole derivative may be a compound having one triazole ring in one molecule (triazole monomer), a compound having two triazole rings, and a compound having three triazole rings.

Examples of the triazole monomer include compounds each having a triazole ring which has at least one functional group such as an amino group $NH_2$), an alkyl group or an alkoxy group.

Examples of the compound having two triazole rings in one molecule include compounds each having a bitriazole skeleton in which two triazole rings are directly bonded by a carbon-carbon single bond (bitriazole derivative). Examples of the bitriazole derivative include bitriazole.

In addition, the compound having a plurality of triazole rings in one molecule is preferably polyvinyl triazole which is a polymer of vinyl triazole, and specifically, more preferably poly(1-vinyl-1,2,4-triazole).

It is preferable for the polyvinyl triazole such as the poly(1-vinyl-1,2,4-triazole) to have a molecular weight of a certain level or larger, from the viewpoints of the conversion efficiency, selectivity and the like. The weight-average molecular weight is, for example, 1,000 or larger, and is preferably 10,000 or larger; and in addition, the weight-average molecular weight is, for example, 200,000 or smaller, and is preferably 100,000 or smaller, from the viewpoint of ease of availability, and the like.

In the raw material mixture for first catalyst, the nitrogen-containing compounds may be used singly, or two or more types thereof may be used in combination.

It is preferable that the amount of the nitrogen-containing compound to be blended in the raw material mixture for first catalyst be adjusted so that a molar ratio of the nitrogen-containing aromatic ring of the nitrogen-containing compound to the metal element of the above metal derivative (nitrogen-containing aromatic ring/metal element) is 2 or larger and 20 or smaller. When the amount is set in the above range, the generation of a side reaction can be suppressed, and a catalyst containing the bond between metal and nitrogen elements in an appropriate amount can be produced; and it becomes easy to enhance the above conversion efficiency and the like. From the viewpoints of the conversion efficiency and the like, the above molar ratio is more preferably 2 or larger, is further preferably 4 or larger; and is more preferably 18 or smaller, and is still more preferably 15 or smaller. The above molar ratio represents a ratio between the number of nitrogen-containing aromatic rings contained in the nitrogen-containing compound and the number of moles of metal elements contained in the metal derivative.

The carbon compound which is used in the nitrogen-containing metal catalyst is not particularly limited as long as the carbon compound can support a heat-treated product (for example, sintered product) of a nitrogen-containing compound such as a pyridine derivative and a metal derivative, but an electroconductive carbon compound is preferable. When the electroconductive carbon compound is used, the electric conductivity at the cathode becomes high, and it becomes easy to enhance the efficiency of conversion to the carbon monoxide. Specific examples of the carbon compound are as described above; and carbon black is preferable, and electroconductive carbon black is further preferable.

The content of the carbon compound in the raw material mixture for first catalyst is not particularly limited, but is, for example, 10% by mass or more and 90% by mass or less, is preferably 15% by mass or more and 80% by mass or less, and is more preferably 20% by mass or more and 70% by mass or less, with respect to the total amount of the raw material mixture for first catalyst. When the content of the carbon compound is set in the above range, a heat-treated product of the metal derivative and the nitrogen-containing compound can be supported appropriately while maintaining satisfactory catalytic activity.

The nitrogen-containing metal catalyst may be powdery or particulate. When in powdery or particulate form, the nitrogen-containing metal catalyst can be easily supported on an electrode substrate which will be described later. In addition, the contact area with respect to carbon dioxide can be increased easily, and the efficiency of conversion to the carbon monoxide can be improved easily.

The nitrogen-containing metal catalyst obtained by the heat treatment contains the metal element and the nitrogen element as described above, and it is preferable that the metal element be contained in the nitrogen-containing metal catalyst as a metal oxide, from the viewpoints of the selectivity, the ease of the production, and the like. The metal element is preferably cobalt, as described above, and accordingly, it is preferable that the nitrogen-containing metal catalyst contain cobalt oxide. In addition, it is particularly preferable that the cobalt oxide contain CoO.

In addition, as described above, the nitrogen-containing metal catalyst preferably contains a component derived from a nitrogen-containing compound by the heat treatment, and specifically, more preferably contains a component derived from a pyridine derivative. Accordingly, it is particularly preferable that the nitrogen-containing metal catalyst have CoO and a component derived from the pyridine derivative. In addition, a nitrogen atom derived from the nitrogen-containing compound may be coordinated to a metal element such as cobalt element.

It is preferable that the component derived from the nitrogen-containing compound contain a nitrogen-containing aromatic ring structure, and specific examples thereof include a pyridine ring structure, an imidazole ring structure, a pyrazole ring structure, and a triazole ring structure. Among the structures, a pyridine ring structure, an imidazole ring structure and a triazole ring structure are preferable, and the pyridine ring structure is particularly preferable. It is assumed that the activation energy of a reaction intermediate becomes low by the coordination of cobalt to nitrogen of the pyridine ring structure; and thereby the conversion efficiency and the like become high.

Furthermore, as described above, the nitrogen-containing metal catalyst is produced by the heat treatment of a mixture containing the nitrogen-containing compound, but the treatment temperature thereof is low. Accordingly, the nitrogen-containing aromatic ring contained in the nitrogen-containing compound can remain also in the nitrogen-containing metal catalyst.

It can be confirmed by X-ray photoelectron spectroscopy (XPS) or the like that the nitrogen-containing metal catalyst has a nitrogen-containing aromatic ring structure such as the pyridine ring structure. In addition, it can be also confirmed by X-ray photoelectron spectroscopy (XPS) that nitrogen element is coordinated to the metal element such as cobalt element. Furthermore, the valence of the metal element, for example, that the cobalt oxide is divalent, can be confirmed by XPS, X-ray diffraction measurement (XRD) or the like.

In addition, the nitrogen-containing metal catalyst may contain various metal elements as metals, in addition to the above metal oxide. Accordingly, when the metal element is cobalt, cobalt metal may be contained in addition to the cobalt oxide. The cobalt metal may have, for example, crystallinity. In a case where the nitrogen-containing metal catalyst contains cobalt metal, it is preferable that the nitrogen-containing metal catalyst have a core-shell structure in which cobalt metal serves as a core and cobalt oxide is arranged around the core so as to cover the cobalt metal. It is assumed that when the nitrogen-containing metal catalyst has the core-shell structure, the nitrogen-containing metal catalyst improves its electroconductivity, and becomes to easily improve a reduction ratio of carbon dioxide or the like. In addition, the core-shell structure may be particulate and supported on the carbon compound.

<<Method for Producing Nitrogen-Containing Metal Catalyst>>

The nitrogen-containing metal catalyst can be produced by the heat treatment of a raw material mixture for first catalyst which contains a metal derivative and a nitrogen-containing compound such as a pyridine derivative, or contains a metal derivative, a nitrogen-containing compound and a carbon compound. At this time, it is preferable that the raw material mixture for first catalyst be heated to and heat-treated at a heat treatment temperature of 150° C. or higher and 550° C. or lower. When the heat treatment temperature is set in the above range, the raw material mixture for first catalyst can appropriately form the bond between metal and nitrogen elements, which is derived from the metal derivative and the nitrogen-containing compound, by the heat treatment such as sintering, while suppressing the formation of unnecessary byproducts, and can impart appropriate catalytic activity to the nitrogen-containing metal catalyst. In addition, when with the above upper limit or lower, the electrochemical cell can be easily industrially practical.

The heat treatment temperature is preferably from 180° C. or higher and 500° C. or lower, is more preferably from 200° C. or higher and 470° C. or lower, and is further preferably from 250° C. or higher and 450° C. or lower, from the viewpoints of improving the catalytic activity and enhancing the conversion efficiency when the catalyst is used in the electrode for reducing carbon dioxide, and from the viewpoint of the practical application.

In addition, it is preferable that the above heat treatment be performed in an inert gas atmosphere such as argon or a nitrogen gas.

With heat-treating raw material mixture for first catalyst at the heat treatment temperature described above, the bond between metal and nitrogen elements can be formed, and components derived from the metal derivative and the nitrogen-containing compound can be supported on the carbon compound. The period of time while the mixture is heat-treated (heat treatment time) is not particularly limited, but is, for example, 0.5 hours or longer and 10 hours or shorter, is preferably 1 hour or longer and 8 hours or shorter, and is more preferably 2 hours or longer and 5 hours or shorter.

It is preferable that the raw material mixture for first catalyst to be heat-treated be powdery or particulate. When the mixture is powdery or particulate, a powdery or particulate catalyst can be obtained by the heat treatment. In addition, it is more preferable that the raw material mixture for first catalyst to be heat-treated include a metal derivative, a nitrogen-containing compound and a carbon compound.

The raw material mixture for first catalyst may be obtained, for example, by preparing a diluted liquid of a raw material mixture for first catalyst, in which a metal derivative and a nitrogen-containing compound, or a metal derivative, a nitrogen-containing compound and a carbon compound are diluted in a diluting solvent, and then drying the diluted liquid. The raw material mixture for first catalyst may be obtained, for example, in a form of a powder or a particle.

In addition, it is preferable that in the diluted liquid of the raw material mixture for first catalyst, each component (metal derivative, nitrogen-containing compound, and carbon compound) be dispersed or dissolved in the diluting solvent. When each component is dispersed or dissolved in the diluting solvent, the raw material mixture for first catalyst can be obtained in which each component is homogeneously mixed.

The method of obtaining the above diluted liquid of the raw material mixture for first catalyst is not particularly limited, but, for example, the diluted liquid may be obtained by firstly adding a nitrogen-containing compound into a dispersion medium for dispersion, and further adding a metal derivative and if necessary, a carbon compound to the dispersion liquid.

As the diluting solvent which is used for diluting the raw material mixture for first catalyst, water and an organic solvent can be used, and the organic solvent is preferable. Examples of the organic solvent include ester-based solvents, ketone-based solvents, ether-based solvents, alcohol-based solvents, glycol ethers, amide-based solvents, nitrile-based solvents, carbonate-based solvents, halogenated hydrocarbons, hydrocarbons, sulfone-based solvents, sulfoxides and formamides; and are not particularly limited. In addition, as the diluting solvent, a mixed solvent of an organic solvent and water may be used.

A concentration of the diluted liquid of the raw material mixture for first catalyst is not particularly limited, but is, for example, 0.01 to 50 g/L, and is preferably 1 to 10 g/L.

The first catalyst may be a carbon compound which contains at least one of a hetero atom such as nitrogen, a metal or a metal compound, in addition to the above. Examples of such carbon compounds include nitrogen-containing graphite, nitrogen-containing carbon nanotubes, nitrogen-containing graphene, Ni and nitrogen-containing graphite, Ni and nitrogen-containing carbon nanotubes, Ni and nitrogen-containing graphene, Cu and nitrogen-containing graphite, Cu and nitrogen-containing carbon nanotubes, Cu and nitrogen-containing graphene, Co and nitrogen-containing graphite, Co and nitrogen-containing carbon nanotubes, and Co and nitrogen-containing graphene.

In the electrochemical cell 10, the first catalysts may be used singly, or two or more types thereof may be used in combination.

(Electrode Substrate)

The cathode 11 may contain the electrode substrate. The electrode substrate is not particularly limited as long as the electrode substrate is a substrate which is conventionally used for the electrode for reducing carbon dioxide; includes a carbon substrate, a metal substrate, and a metal oxide substrate; and preferably has electroconductivity. In addition, it is preferable that the substrate be a porous body. The substrate serves as a substrate which constitutes the electrode, and may have, for example, a sheet shape or a plate shape.

Among the above, the carbon substrate is preferable, and porous carbon is more preferable. Specific examples of the porous carbon include a carbon non-woven fabric. The carbon non-woven fabric is not particularly limited, and a known carbon non-woven fabric can be used. For example, a commercially available carbon non-woven fabric for a fuel cell can be used; and examples thereof include "Treca" (registered trademark) carbon paper produced by Toray Industries, Inc, "AvCarb1071HCB" produced by New Metals and Chemicals Corporation, Ltd., and BC series produced by Sumisho Global Logistics Co., Ltd.

In addition, examples of the metal substrate include a metal mesh, and examples of the metal to be used include gold, silver, platinum, nickel, titanium and chromium. In addition, examples of a metal oxide which is used for the metal oxide substrate include indium oxide, tin oxide, tin-doped indium oxide, and fluorine-doped tin oxide.

The first catalyst may be supported on the electrode substrate. The method for causing the first catalyst to support the electrode substrate thereon is not particularly limited, and the first catalyst may be attached to the electrode substrate, and in particular, it is preferable to cause the above nitrogen-containing metal catalyst to attach to the electrode substrate. Note that the attachment described here refers to a mode in which the catalyst is physically fixed to the electrode substrate, and that atoms constituting the electrode substrate do not chemically bond to atoms constituting the catalyst. Accordingly, even when the electrode substrate contains the carbon compound such as the porous carbon, the carbon compound itself does not have the above bond between metal and nitrogen elements. In addition, the carbon compound does not also have a bond between metal and carbon element. For information, the carbon element described here is a carbon element constituting the carbon compound such as the porous carbon, and the metal is a metal element derived from the metal derivative. When the nitrogen-containing metal catalyst does not chemically bond to but attaches to the electrode substrate, it becomes easy to improve the efficiency of conversion to the carbon monoxide, and the production thereof also becomes easy.

However, the atoms constituting the first catalyst may chemically bond to the atoms constituting the electrode substrate; and for example, when the electrode substrate contains the carbon compound such as the porous carbon, the carbon compound itself may have the above bond between metal and nitrogen elements or the bond between metal and carbon elements.

(Catalyst Additive)

In addition, the first catalyst may be supported on the electrode substrate together with a catalyst additive or the like. The catalyst additive also functions as a binding agent at the time when the catalyst is supported on the electrode substrate. Furthermore, the catalyst additive also functions as an ion conductor, and improves an efficiency of the electrochemical reaction.

Examples of the catalyst additive include cationic conductive compounds. The cationic conductive compound is, for example, a functional group having a Bronsted acid or a salt thereof, and examples thereof include a compound having a functional group which is anionized by release of a hydrogen ion or the like.

Examples of the cationic conductive compound include compounds each having at least one functional group such as a sulfonyl group, a phosphoric acid group, a hydroxyl group, and a silicic acid group. Specific examples include fluororesin-based sulfonic acids such as perfluoroethylene sulfonic acid, sulfonated poly(ether ether ketone) (SPEEK), sulfonated poly(ether ether ketone ketone) (SPEEKK), sulfonated poly(fluorenyl ether nitrile oxynaphthalate) (PFENO), poly(styrene sulfonic acid), polyvinyl sulfonic acid, and poly(2-acrylamide-2-methyl-1-propane sulfonic acid) (PAMPS). silicotungstic acid-polyvinyl alcohol (SiWA-PVA), and phosphoric acid-doped polybenzimidazole (PBI).

Examples of the perfluoroethylene sulfonic acid include copolymers of tetrafluoroethylene and perfluoro[2-(fluorosulfonylethoxy)propyl vinyl ether]; and commercial products include "Nafion" (trademark of DuPont).

Examples of the catalyst additive also include anionic conductive compounds. Examples of the anionic conductive compound include compounds having a functional group which has a Bronsted base or a salt thereof; and are compounds each having a functional group which is cationized, for example, by addition of a proton. The anionic conductive compound is excellent in the conductivity of an anion such as a hydroxide ion.

Specific examples of the anionic conductive compound include compounds each having a functional group such as a pyridinium group, an imidazolium group, an amino group and an ammonium group. In addition, the amino group may be any of a primary amino group, a secondary amino group and a tertiary amino group, but the secondary amino group and the tertiary amino group are preferable. In addition, the ammonium group is a quaternary ammonium group. Among them, compounds each having the imidazolium group are preferable. When the compound having the imidazolium group is used, for example, almost no other reduction products are produced, resulting in enhanced efficiency of conversion to the carbon monoxide. Examples of the compound having the imidazolium group include imidazolium chloride.

Examples of the anionic conductive compound include a styrene-based polymer having the imidazolium group, polyethyleneimine, a styrene-based polymer having the amino group or the ammonium group, and an acrylic polymer having the amino group or the ammonium group.

The anionic conductive compound may also be one in which an additive having the functional group is added to a base polymer. Examples of the base polymer include polystyrene, polyvinyl alcohol and polyurethane, in addition to the polymers. Examples of the additive include a metal oxide, a silicon compound and a boron compound.

In addition, the cationic conductive compound may also be a compound in which an additive having the above functional group is added to a base polymer such as polystyrene, polyvinyl alcohol or polyurethane, in addition to the polymers.

Examples of the acrylic polymer having the amino group or the ammonium group, which is used for the catalyst additive, include acrylic polymers each having a polyamine structure in the side chain. Examples of the styrene-based polymer having the amino group or the ammonium group include a styrene-based polymer having a polyamine structure in the side chain, a styrene-based polymer having a tertiary amino group in the side chain, and a styrene-based polymer having a quaternary ammonium group in the side chain. As these acrylic polymers and styrene-based polymers, "DIAION" series produced by Mitsubishi Chemical Corporation can be used as commercial products, and for example, the products can be used which are sold as weak basic anion exchange resins and strong basic anion exchange resins.

Examples of the styrene-based polymer having the imidazolium group, which is used as the catalyst additive, include the above-mentioned PSMIM, PSTMIM and PSDMIM.

In addition, as the anionic conductive compound, "Fumion FAA-3-SOLUT-10" produced by FuMA-Tech GmbH, "PowerMaxNXS1250H" produced by Resintec Co., Ltd., and the like can also be used as commercial products.

The catalyst additive may have, for example, a powdery or particulate shape.

In addition, as the catalyst additive, it is also allowed to use a compound other than the cationic conductive compound and the anionic conductive compound, and for example, to use a fluorine compound other than the cationic conductive compound and the anionic conductive compound. Specific examples of such a fluorine compound include polytetrafluoroethylene (PTFE), tetrafluoroethylene oligomer (TFEO), fluorinated graphite ((CF)n), and fluorinated pitch (FP).

It is preferable for the catalyst additive to be fluorine compounds, is more preferable to be fluorine resin-based sulfonic acids among the fluorine compounds, and is particularly preferable to be perfluoroethylene sulfonic acid.

When the catalyst additive is used, the first catalyst may be mixed with the catalytic additive, and then may be supported on the electrode substrate in a form of a mixture (catalyst composition).

When the catalyst is supported on the electrode substrate together with the catalyst additive, the content of the catalyst additive with respect to the total amount of the catalyst additive and the catalyst is preferably 10 to 50% by mass, is more preferably 15 to 45% by mass, is further preferably 20 to 40% by mass, from the viewpoint of enhancing the conversion efficiency of the catalyst, and the like.

A method for causing the electrode substrate to support the first catalyst thereon is not particularly limited, and examples thereof include: a method of preparing a diluted liquid in which components of the first catalyst and components other than the catalyst such as a catalyst additive which are added as needed are diluted in a diluting solvent, applying the diluted liquid to the electrode substrate with the use of various coating apparatuses, or by spray coating or the like, followed by drying; and a method of immersing the electrode substrate in the above diluted liquid, and drying the resultant liquid.

In the cathode, the first catalyst (or catalyst composition) may be formed as a catalyst layer on the surface of the electrode substrate in a layered shape, by applying a coating liquid containing the catalyst or the like. In addition, the catalyst layer may be formed in a layer shape so that a part or the whole thereof is impregnated into a part or the whole of the inside of the electrode substrate in the thickness direction, or may be formed, for example, in a layer shape from the surface to the inside of the electrode substrate. The catalyst layer may appropriately have voids.

Accordingly, the catalyst may be supported on and the catalyst layer may be formed on one surface of the electrode substrate, and the catalyst may not be supported on and the catalyst layer may not be formed on the other surface, but the catalyst may be supported on both the surfaces.

In addition, the above diluted liquid is preferably a dispersion liquid in which the catalyst, or the catalyst and components other than the catalyst are dispersed in a diluting solvent; and it is acceptable to use water or an organic solvent. The organic solvent is as described above, but an alcohol solvent, a ketone solvent, a nitrile solvent or the like may be preferably used. The above diluted liquid may also be a mixed solution of an organic solvent and water.

[Electrolyte Solution]

The electrolyte solution 13 is filled in the inside of the electrochemical cell 10, and includes a second catalyst, a reactant and a redox species, in the present embodiment.

(Second Catalyst)

The second catalyst is not particularly limited as long as the catalyst catalyzes an electrochemical reaction for synthesizing the carbonyl compound from the carbon monoxide, and may contain a metal element, and specifically, preferably contains a metal element selected from the group consisting of elements of Group 8 to Group 11. When the elements of Group 8 to Group 11 are used in the catalyst, it becomes easy for the catalyst to electrochemically synthesize the carbonyl compound, particularly one or both of an organic carbonate and an organic oxalate, from the carbon monoxide, at high selectivity.

Examples of the carbonyl compound include organic carbonates, organic oxalates, urea-based compounds and carbonyl halides. Among them, at least one of an organic carbonate and an organic oxalate is preferable, and an organic carbonate is more preferably. Accordingly, the second catalyst is preferably a catalyst that catalyzes a reaction which synthesizes the organic carbonate, the organic oxalate, or both of these, and is more preferably a catalyst that catalyzes a reaction which synthesizes at least the organic carbonate.

Specific examples of elements of Group 8 to Group 11, which is used in the second catalyst, include Fe, Co, Ni, Cu, Ru, Rh, Pd, Ag, Os, Ir, Pt and Au. Among them, Co, Ni, Cu, Rh, Pd, Ag, Ir, Au and Pt are preferable, and among the above, Pd, Au, Ag and Ir are more preferable. When each of the above elements is used, it becomes easy to electrochemically synthesize the organic carbonate, the organic oxalate, or both of these, from the carbon monoxide at high selectivity. From these viewpoints, the metal elements contained in the catalyst are more preferably Au and Pd, and are particularly preferably Pd.

The metal elements which are used in the second catalyst may be used singly, or two or more types thereof may be used in combination. When two or more types are used in combination, two or more types of metal elements selected from the group consisting of elements of Group 8 to Group 11 may be used in combination, or metal elements of Group 8 to Group 11 and metal elements other than elements of Group 8 to Group 11 may be used in combination. The metal elements other than elements of Group 8 to Group 11 preferably include metal elements in the fourth periodic elements, but may be metal elements other than those of the fourth periodic elements.

Specifically, it is preferable to combine Au with at least one selected from the group consisting of Ti, Mn, Fe, Co, Ni, Cu and Zn. In addition, it is also preferable to combine Pd with at least one selected from the group consisting of Ti, Co, Ni, Cr, Mn, Fe, Cu, Zn, Ru, Rh, Ag, Ir, Pt, Au and Sn. Furthermore, it is also preferable to combine Ir with at least one selected from the group consisting of Au, Rh and Ru. According to such a combination, when the carbonyl compound is synthesized, high selectivity can be maintained while the amount of noble metal to be used is suppressed.

When two or more types of metal elements are used in combination in the second catalyst, from the viewpoint of improving the selectivity, it is preferable that the metal elements contain at least two types selected from the group consisting of elements of Group 8 to Group 11. Among them, it is more preferable to use either Pd or Ir, and at least one element selected from the group consisting of elements of Group 8 to Group 11 other than either Pd or Ir, in combination. Specifically, a combination of Pd and at least one selected from the group consisting of Ag, Au, Pt, Ir and Cu, or a combination of Ir and one selected from the group consisting of Au, Rh and Ru is more preferable.

When two or more metals are used in combination, it is acceptable to appropriately set a content of each metal; but when Pd is used, the content of Pd is, for example, 10 to 99 mol %, and is preferably 25 to 95 mol % from the viewpoint of the selectivity. In this case, a content of a metal other than Pd (for example, at least one selected from the group consisting of Ag, Au, Pt, Ir and Cu) is, for example, 1 to 90 mol %, and is preferably 5 to 75 mol %.

In addition, when Ir is used not in combination with Pd, a content of Ir is, for example, 5 to 99 mol %, is preferably 10 to 95 mol %, and is more preferably 25 to 90 mol %, from the viewpoint of the selectivity. In this case, a content of a metal other than Ir (for example, at least one selected from the group consisting of Au, Rh and Ru) is, for example, 1 to 95 mol %, is preferably 5 to 90 mol %, and is more preferably 10 to 75 mol %.

Note that the content of the metal referred to here is a ratio to the total amount of the metal contained in the catalyst.

The second catalyst may be an active particle-containing catalyst, a metal salt, or a combination thereof, as will be described below. When the active particle-containing catalyst or the metal salt is used, which will be described later, it is possible to produce the carbonyl compound, particularly the organic carbonate, the organic oxalate or both of these, from the carbon monoxide, at high conversion efficiency. Among them, it is preferable to use the active particle-containing catalyst.

<<Active Particle-Containing Catalyst>>

In one embodiment, it is preferable that the second catalyst be a catalyst which contains an active particle having the above metal element (hereinafter also referred to as an "active particle-containing catalyst").

The active particle in the active particle-containing catalyst has catalytic ability which catalyzes the reaction at the time when the carbonyl compound is electrochemically synthesized from the carbon monoxide. The active particle containing a metal element is not particularly limited as long as the particle contains a metal element; and may be composed of a metal oxide, may be composed of the metal itself, or may also be composed of both the metal oxide and the metal. The metal elements which are used in the active particle are as described above.

In the second catalyst, the active particles are particulate, for example, and are not particularly limited, but are preferable to be a nano-order particles; and preferably have an average particle size of 100 nm or smaller, and more preferably of 1 nm or larger and 40 nm or smaller. The active particles have each the above particle diameter, and are each nanostructured; and thereby increase the active area, and become to easily improve various performances of the catalyst. Note that the particle diameter means an area equivalent circle diameter which is obtained by determining an area of each particle in image observation with TEM-EDX or the like and calculating the diameter from the area determined on the assumption that each particle is a circle.

In addition, it is preferable that the active particle-containing catalyst further contain a support, and that the active particles be supported on the support. The support to be used in the active particle-containing catalyst is not particularly limited, but is preferably porous carbon, from the viewpoint of synthesizing the carbonyl compound from the carbon monoxide at high selectivity. Accordingly, in one embodiment, it is preferable that the second catalyst (active particle-containing catalyst) contained in the electrolyte solution be a catalyst which has the active particles having metal elements and the porous carbon supporting the active particles thereon. When the support is the porous carbon, a reactant that will be described later appropriately diffuses into the catalyst, and the catalyst becomes to easily improve the selectivity, the reaction efficiency and the like, at the time when the carbonyl compound is synthesized.

The active particle-containing catalyst having the support such as the porous carbon can be produced by mixing a metal precursor and the porous carbon (support) and subjecting the mixture to heat treatment, as will be described later. The metal precursor becomes active particles by the heat treatment, and the active particles are supported on the porous carbon (support).

The porous carbon which is used in the active particle-containing catalyst is not particularly limited, but is preferably formed of a powdery or particulate carbon compound; and also the active particle-containing catalyst may be thereby powdery or particulate. When the active particle-containing catalyst is powdery or particulate, it becomes easy for the catalyst to disperse the active particle-containing catalyst in the electrolyte solution, increase the contact area with the carbon monoxide, and improve the selectivity, the reaction efficiency and the like, at the time when synthesizing the carbonyl compound.

The BET specific surface area of the porous carbon which is used in the active particle-containing catalyst is, for example, 10 $m^2/g$ or larger and 3000 $m^2/g$ or smaller, and is preferably 100 $m^2/g$ or larger and 1500 $m^2/g$ or smaller. When the surface area of the porous carbon is set in the above range, an appropriate amount of active particles is supported on the porous carbon; and the catalyst has thereby appropriate catalytic activity, and becomes to easily enhance the selectivity, the reaction efficiency and the like, at the time when synthesizing the carbonyl compound. The BET specific surface area can be measured by gas adsorption analysis.

An average primary particle diameter of the porous carbon which is used in the active particle-containing catalyst is, for example, 1 nm or larger and 1000 nm or smaller, and is preferably 10 nm or larger and 300 nm or smaller. When the average primary particle diameter of the porous carbon is set in the above range, active particles having nanosize are appropriately supported on the porous carbon, and the selectivity, the reaction efficiency and the like at the time of synthesizing the carbonyl compound can be easily enhanced. In addition, it becomes easy for the active particle-containing catalyst to be easily dispersed in the electrolyte solution. The average primary particle diameter of the porous carbon can be measured, for example, by observation by electron microscope observation, and the specific method includes a method of determining the area equivalent circle diameter which is obtained by determining an area of each particle and calculating the diameter from the area determined on the assumption that each particle is a circle.

An average pore diameter of the porous carbon is, for example, 0.5 nm or larger and 100 nm or smaller, and is preferably 1 nm or larger and 50 nm or smaller. When the average pore diameter is set in the above range, the reactant becomes to easily diffuse into the catalyst, and the catalyst becomes to easily improve the selectivity of the organic carbonate and the like, the reaction efficiency and the like. For information, the average pore diameter of the porous carbon can be measured by gas adsorption analysis.

The porous carbon which is used in the active particle-containing catalyst is not particularly limited as long as the porous carbon can support active particles thereon, but an electroconductive carbon compound is preferable. When the electroconductive carbon compound is used, the electrical conductivity of the electrode becomes high, and the reaction efficiency and the like can be enhanced easily.

Specific examples of the porous carbon include mesoporous carbon, activated carbon, carbon black such as Ketjhen Black and acetylene black, carbon nanotubes, graphite and graphene; and among the above, carbon black is preferable; and it is more preferable for the carbon black to be electroconductive carbon black.

The active particle-containing catalyst may further have a component derived from the nitrogen-containing compound. When the active particle-containing catalyst contains a component derived from the nitrogen-containing compound, it is easy for the catalyst to improve the conversion efficiency, the selectivity and the like, at the time when synthesizing the carbonyl compound.

The component derived from the nitrogen-containing compound may have nitrogen element, and the nitrogen element may be coordinated to a metal element constituting the active particle (for example, a metal element constituting the metal oxide) and form a bond between metal and nitrogen elements, by the coordinate bond.

The component derived from the nitrogen-containing compound may be supported on the porous carbon. In other words, the component derived from the nitrogen-containing compound may be coordinated to the metal element constituting the active particle and may be supported on the porous carbon. It is preferable that the nitrogen-containing compound have a nitrogen-containing aromatic ring structure in which nitrogen is contained in the aromatic ring.

When the active particle-containing catalyst contains a component derived from the nitrogen-containing compound, the active particle-containing catalyst can be obtained by heat treatment of a mixture of a metal precursor, porous carbon and a nitrogen-containing compound, as will be described later. Accordingly, the component derived from the nitrogen-containing compound is a component obtained by the heat treatment of the nitrogen-containing compound.

In the present invention, the heat treatment temperature becomes low as will be described later, and the nitrogen-containing aromatic ring structure composed of the nitrogen-containing compound thereby remains in the catalyst. In addition, it is preferable that the component derived from the nitrogen-containing compound in the active particle-containing catalyst have the nitrogen-containing aromatic ring structure. The details of the nitrogen-containing compound and the nitrogen-containing aromatic ring structure are as described in the first catalyst.

<<Method for Producing Active Particle-Containing Catalyst>>

Next, a method for producing the active particle-containing catalyst will be described. The above active particle-containing catalyst may be obtained by heat treatment of at least the metal precursor; and can be preferably obtained by mixing the metal precursor and the porous carbon, and heat-treating the mixture containing the metal precursor and the porous carbon. Note that the metal precursor or the mixture containing the metal precursor and the porous carbon, which becomes a raw material of the active particle-containing catalyst, is hereinafter also referred to as a second catalyst raw material. The heat treatment is typically sintered. In addition, when the active particle-containing catalyst includes a component derived from the nitrogen-containing compound, the nitrogen-containing compound may be further mixed with the metal precursor and the porous carbon, and the second catalyst raw material may include the metal precursor, the porous carbon and the nitrogen-containing compound.

The metal precursor is a compound which becomes the above active particle by the heat treatment. Accordingly, the metal precursor may be a precursor containing a metal element selected from the group consisting of the above elements of Group 8 to Group 11, and suitable metal elements are also as described above. The metal elements which are used in the metal precursor may be used singly, or two or more types thereof may be used in combination. When two or more types are used in combination, the combination of the metal elements is as described above.

When two or more types of metal precursors are used in combination, the active particle-containing catalyst may be obtained by mixing two or more types of metal precursors, or by mixing two or more types of metal precursors and the porous carbon, and subjecting the mixture to the heat treatment; and accordingly two or more types of metal precursors may be contained in the second catalyst raw material.

It is preferable that the metal precursor include a metal ion. In addition, the metal precursor may be used, for example, in the form of a metal salt. Examples of the metal salt include a metal nitrate, a metal sulfate, a metal chloride, a metal bromide, a metal iodide and a metal acetate; and among them, the metal chloride and the metal nitrate are preferable, and the metal nitrate is more preferable from the viewpoint of being capable of forming an appropriate active particle.

In addition, specific examples of the metal nitrate and the metal chloride which are used in the metal precursor are the same as those of the metal salts that are used as the second catalyst which will be described later, and the description thereof will be omitted. In addition, the metal salt may also be a hydrate.

In addition, the porous carbon and the nitrogen-containing compound are as described above which are used as raw materials in the present production method.

It is preferable for a content of the metal derived from the above metal precursor in the second catalyst raw material to be 0.1% by mass or more and 70% by mass or less, and is more preferable to be 2% by mass or more and 50% by mass or less, with respect to the total amount of the second catalyst raw material. When the content is set in the above range, the metal is contained in the catalyst without causing agglomeration, and an appropriate amount of the catalytic active points are formed. Because of this, the selectivity and the like at the time of synthesizing the carbonyl compound can be enhanced easily, and the reaction efficiency and the like also become high.

In addition, a content of the porous carbon in the second catalyst raw material is not particularly limited; but is, for example, 10% by mass or more and 95% by mass or less, is preferably 20% by mass or more and 85% by mass or less, and is more preferably 30% by mass or more and 80% by mass or less, with respect to the total amount of the second catalyst raw material. With the content of the porous carbon set in the above range, the active particles and the components derived from the nitrogen-containing compound can be supported appropriately, while adequately keeping the catalytic activity.

When the nitrogen-containing compound is used, the amount of the nitrogen-containing compound to be blended in the second catalyst raw material is adjusted so that a molar ratio of the nitrogen-containing aromatic ring of the nitrogen-containing compound to the metal element derived from the above metal precursor (nitrogen-containing aromatic ring/metal element) is preferably 0.1 or larger and 30 or smaller, and is more preferably 1 or larger and 20 or smaller.

The temperature at which the second catalyst raw material is heat-treated is preferably 150° C. or higher and 800° C. or lower. When the heat treatment temperature is set in the above range, the second catalyst raw material can be appropriately heat-treated while suppressing the formation of unnecessary byproducts. Because of this, it becomes possible for the active particles to be formed from the metal precursor, and to be appropriately supported on the porous carbon. In addition, it becomes possible to prevent the migration of the active particles, and reduce the particle diameters of the active particles, and it becomes easy to increase the surface area of the catalyst and the like. In addition, when the second catalyst raw material contains a nitrogen-containing compound, it becomes possible to cause the nitrogen contained in the nitrogen-containing compound coordinate to the metal of the active particle, and cause a component derived from the nitrogen-containing compound to be appropriately supported on the porous carbon. Furthermore, when the above heat treatment temperature is lowered as described above, it becomes easy for the nitrogen-containing aromatic ring structure of the nitrogen-containing compound to be maintained even in the catalyst to be produced.

From the viewpoints described above, the heat treatment temperature is preferably 180° C. or higher and 550° C. or lower, and is more preferably 200° C. or higher and 380° C. or lower.

A time period of the heat treatment is not particularly limited, but is, for example, 0.25 hours or longer and 10 hours or shorter, is preferably 0.5 hours or longer and 8 hours or shorter, and is more preferably 1 hour or longer and 5 hours or shorter.

In addition, the above heat treatment may be performed in an inert gas atmosphere such as argon or nitrogen gas, or in a reducing atmosphere such as hydrogen.

It is preferable that the second catalyst raw material to be heat-treated be powdery or particulate. When the second catalyst raw material is made powdery or particulate, the catalyst obtained by the heat treatment can also be powdery or particulate. In addition, it is more preferable that the second catalyst raw material to be heat-treated includes a metal precursor and a porous carbon, or a metal precursor, a porous carbon and a nitrogen-containing compound.

The second catalyst raw material may be obtained, for example, by preparing a diluted liquid of the second catalyst raw material, and drying the diluted liquid. It is preferable that in the diluted liquid of the second catalyst raw material, each component (metal precursor and porous carbon, or metal precursor, nitrogen-containing compound and porous carbon) be dispersed or dissolved in a diluting solvent. When each component is dispersed or dissolved in the diluting solvent, the second catalyst raw material can be obtained in which each component is homogeneously mixed.

As the diluting solvent which is used for diluting the second catalyst raw material, water and an organic solvent can be used, and water is preferable. Specific examples of the organic solvent are as described above. In addition, as the diluting solvent, a mixed solvent of an organic solvent and water may be used. A concentration of the second catalyst raw material in the diluted liquid is not particularly limited, but is, for example, 0.01 to 25 g/L, and is preferably 0.1 to 5 g/L.

<<Metal Ions>>

The above metal element may be contained in the electrolyte solution in a form of a metal ion, as the second catalyst. Accordingly, in one embodiment, the second catalyst is a metal salt, and may be blended in the electrolyte solution, as the metal salt. Examples of the metal salt include a metal nitrate, a metal sulfate, a metal chloride, a metal bromide, a metal iodide and a metal acetate; and among them, the metal chloride and the metal nitrate are preferable, and the metal chloride is more preferable. Specifically, examples of the metal nitrate include cobalt nitrate ($Co(NO_3)_2$), nickel nitrate ($Ni(NO_3)_2$), copper nitrate ($Cu(NO_3)_2$), rhodium nitrate ($Rh(NO_3)_3$), palladium nitrate ($Pd(NO_3)_2$), silver nitrate ($AgNO_3$), iridium nitrate ($Ir(NO_3)_4$), platinum nitrate ($Pt(NO_3)_4$), gold nitrate ($AuNO_3$), ruthenium nitrate ($Ru(NO_3)_3$), iron nitrate ($Fe(NO_3)_3$), manganese nitrate ($Mn(NO_3)_2$), zinc nitrate ($Zn(NO_3)_2$), chromium nitrate ($Cr(NO_3)_3$), and tin nitrate ($Sn(NO_3)_4$).

In addition, specific examples of the metal chloride include $PdCl_2$, $RuCl_3$, $IrCl_3$, $PtCl_4$ and $AuCl_3$. In addition, $HAuCl_4$ and the like may be included. Among these metal chlorides, $PdCl_2$, $HAuCl_4$ and $Ir(III)Cl_3$ are preferable.

In the electrolyte solution, the second catalysts may be used singly, or two or more types thereof may be used in combination.

The second catalyst in the electrolyte solution may or may not be dissolved in the electrolyte solution, and the second catalyst which does not dissolve may be dispersed in the electrolyte solution. A content of the second catalyst in the electrolyte solution is not particularly limited, and may be adjusted to such an extent that synthesis of the carbonyl compound can proceed appropriately. The specific content of the second catalyst is, for example, 0.001 to 50 g, is preferably 0.01 to 10 g, and is more preferably 0.05 to 1 g, per 1 L of the electrolyte solution.

The content of the second catalyst at the time when the metal salt is a hydrate is an amount excluding the mass of the water molecule in the hydrate.

[Redox Species]

In the first embodiment, the electrolyte solution includes a redox species as an electrolyte. Accordingly, the redox species may be dissolved in a reactant, or in a mixture of the reactant and a solvent for the electrolyte solution, which will be described later. As the redox species, those having the size of molecules or ions smaller than a reactant such as an alcohol-based compound which will be described later, and having an oxidation-reduction activity, can be used. Specific examples of the redox species include metal halide salts, organic redoxes and complex redoxes.

Examples of the metal halide salts include: lithium halide salts such as lithium chloride, lithium bromide and lithium iodide; sodium halide salts such as sodium chloride, sodium bromide and sodium iodide; potassium halide salts such as potassium chloride, potassium bromide, and potassium iodide; cesium halide salts such as cesium chloride, cesium bromide and cesium iodide; and ammonium halides such as ammonium chloride, ammonium bromide and ammonium iodide.

In addition, examples of the organic redoxes include: TEMPO-based radical compounds such as 2,2,6,6-tetramethylpiperidine-1-oxyl (TEMPO), and 4-methoxy-2,2,6,6-tetramethylpiperidine-1-oxyl (MeO-TEMPO); and azaadamantane-N-oxyl (AZADO).

In addition, examples of the complex redoxes include: palladium complexes such as palladium acetylacetonato ($Pd(OAc)_2$) and tetrakis(triphenylphosphine) palladium ($Pd(PPh_3)_4$ complex); and cobalt complexes such as tris(2,2'-bipyridine) cobalt ($Co(bpy)_3$ complex), and tris[1,3-bis(4-pyridyl)propane)] cobalt ($Co(bpp)_3$ complex).

Among the above, metal halide salts are preferable as the redox species, from the viewpoint of enhancing the selectivity of the carbonyl compound; and among them, a metal chloride salt and a metal bromide salt are more preferable, and a metal bromide salt is further preferable.

Accordingly, in the electrolyte solution, halogen ions such as a chlorine ion and a bromine ion are contained, as the redox ions, and particularly preferably the bromine ion is contained.

Preferable specific examples of the metal chloride salt include lithium chloride, potassium chloride and sodium chloride; and among the metal chloride salts, sodium chloride is preferable from the viewpoint of ease of availability. Preferable specific examples of the metal bromide salts include lithium bromide, potassium bromide and sodium bromide, and among these salts, sodium bromide is particularly preferable from the viewpoint of enhancing the selectivity of the carbonyl compound.

The redox species may be used singly, or two or more types thereof may be used in combination.

A concentration of the redox species in the electrolyte solution is not particularly limited, and may be adjusted to such an extent that synthesis of the carbonyl compound can proceed appropriately. A specific concentration of the redox species is, for example, 0.001 to 5.0 M, is preferably 0.01 to 1.0 M, and is more preferably 0.05 to 0.5 M.

[Reactant]

A reactant is contained in the electrolyte solution 13. The reactant is a compound which becomes a raw material of the carbonyl compound. The reactant is changed according to the type of the carbonyl compound (target product) to be produced. For example, when an organic carbonate, an organic oxalate, or both of these are produced, an alcohol-based compound may be used as the reactant. In addition, when a urea-based compound is produced, it is acceptable to use an amine-based compound as the reactant. In addition, in the case where a carbonyl halide such as phosgene is produced, it is acceptable to use halogen, a metal halide salt or the like as the reactant, as will be described later. Among the above, it is preferable to use an alcohol-based compound as the reactant.

(Alcohol-Based Compound)

An alcohol-based compound is a reactant which reacts with the carbon monoxide in the electrochemical cell and forms an organic carbonate, an organic oxalate, or both of these.

The alcohol-based compound may be any of a solid, a liquid and a gas, under an environment in which an electrochemical reaction is performed in the electrochemical cell, but is preferably the liquid. The alcohol-based compound that is a liquid can be easily filled into the electrochemical cell without use of a solvent for the electrolyte solution, which will be described later.

The alcohol-based compound is a compound which has at least one hydroxyl group, and more specifically, is a compound which is represented by the following general formula (1). Note that in the present specification, the "alcohol-based compound" is a concept that includes also an aromatic hydroxy compound represented by phenol, in which a hydroxyl group is directly bonded to an aromatic ring such as a benzene ring, as will be described later.

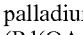

$$ROH \quad (1)$$

(R represents an organic group having 1 to 15 carbon atoms.)

Examples of the organic group having 1 to 15 carbon atoms represented by R in the above general formula (1) include hydrocarbon groups having 1 to 15 carbon atoms. Examples of the hydrocarbon groups include an alkyl group having 1 to 15 carbon atoms, an alkenyl group having 2 to 15 carbon atoms, and an aryl group having 6 to 15 carbon atoms.

Examples of the alkyl group having 1 to 15 carbon atoms include a methyl group, an ethyl group, various propyl groups, various butyl groups, various pentyl groups, various hexyl groups, various heptyl groups, various octyl groups, various nonyl groups, various decyl groups, various dodecyl groups, and various pentadecyl groups.

Examples of the alkenyl group having 2 to 15 carbon atoms include a vinyl group, various propynyl groups, various butynyl groups, various pentinyl groups, various hexenyl groups, various heptenyl groups, various octenyl groups, various nonenyl groups, various decenyl groups, various dodecenyl groups, and various pentadecenyl groups.

Note that "various" means various isomers which include n-, sec-, tert-, and iso-. In addition, the alkyl group or the alkenyl group may be any of a straight-chain form, a branched-chain form and a cyclic form.

Examples of the aryl group having 6 to 15 carbon atoms include a phenyl group and a naphthyl group. In addition, the above hydrocarbon group may have a substituent, and in this case, the number of carbon atoms including the substituent is 1 to 15.

In addition, the organic group having 1 to 15 carbon atoms in the general formula (1) may contain a hetero atom such as a nitrogen atom, an oxygen atom, a sulfur atom, a phosphorus atom or a halogen atom.

Among them, an oxygen atom is preferable. When the organic group has an oxygen atom, it is preferable that the oxygen atom be an oxygen atom of either a hydroxyl group or an ether bond. Accordingly, it is preferable that R be a hydrocarbon group having at least one of the hydroxyl group and the ether bond. In addition, it is preferable that the number of hydroxyl groups be one in R. In other words, the alcohol-based compound may have two hydroxyl groups.

More specifically, it is preferable that the alcohol-based compound having two hydroxyl groups be a group represented by the following formula (1-1).

$$HO—R^{11}—OH \quad (1\text{-}1)$$

Note that in the formula (1-1), $R^{11}$ represents a divalent saturated hydrocarbon group having 2 to 15 carbon atoms, and $R^{11}$ preferably has 2 to 4 carbon atoms, and more preferably has 2 to 3 carbon atoms.

As R in the compound represented by the above general formula (1), among the above, an alkyl group having 1 to 8 carbon atoms, an alkenyl group having 2 to 8 carbon atoms, and an aryl group having 6 to 8 carbon atoms are preferable, and in addition, those represented by the general formula (1-1) in which $R^{11}$ has 2 to 4 carbon atoms are also preferable.

Among them, a compound in which R is an alkyl group or an aryl group is more preferable, and in particular, a compound in which R is an alkyl group is further preferable. In addition, the alkyl group preferably has 1 to 3 carbon atoms, more preferably has 1 or 2 carbon atoms, and most preferably has 1 carbon atom.

Specifically, from the viewpoints of reactivity and production efficiency, methanol, ethanol, phenol, 1-propanol, ethylene glycol, propylene glycol and the like are preferable, and among them, methanol is more preferable.

In addition, the alcohol-based compounds may be used singly, or two or more types thereof may be used in combination.

When the alcohol-based compound is used as the reactant, in the electrochemical cell, such reactions occur as a reaction in which an organic carbonate is formed from the carbon monoxide and the alcohol-based compound (also referred to as first reaction), a reaction in which an organic oxalate is formed from the carbon monoxide and the alcohol-based compound (also referred to as second reaction), or both the reactions.

The above first reaction is a carbonylation reaction in which the organic carbonate is formed, and specifically, an organic carbonate ($(RO)_2CO$) is formed by a reaction represented by the following formula (i).

$$CO+2ROH \rightarrow (RO)_2CO+2H^{+}+2e^{-} \quad (i)$$

Note that in (i), R is the same as the above, but it is preferable for R to be an alkyl group having 1 to 8 carbon atoms, to be an alkenyl group having 2 to 8 carbon atoms, or to be an aryl group having 6 to 8 carbon atoms, is more preferable to be the alkyl group or the aryl group, and is further preferable to be the alkyl group. The alkyl group preferably has 1 to 3 carbon atoms, more preferably has 1 or 2 carbon atoms, and most preferably has 1 carbon atom.

In addition, when ROH is represented by the general formula (1-1), an organic carbonate is formed by a reaction shown by the following formula (ii).

(ii)

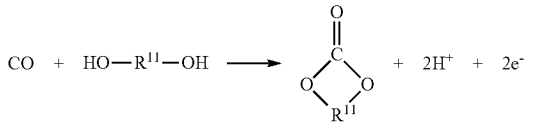

Note that in the formula (ii), $R^{11}$ is the same as the above, but it is preferable for the number of carbon atoms in $R^{11}$ to be 2 to 4, is more preferable to be 2 to 3, and is further preferable to be 2.

Specific preferable organic carbonates include one or more selected from the group consisting of dimethyl carbonate, diethyl carbonate, ethylene carbonate, dipropyl carbonate, propylene carbonate, diphenyl carbonate, ethyl methyl carbonate, methyl propyl carbonate, and ethyl propyl carbonate; and among them, the dimethyl carbonate is more preferable.

The second reaction is a reaction in which an organic oxalate shown by the following formula (2) is formed by the carbon monoxide and the alcohol-based compound. Specifically, the organic oxalate shown by the formula (2) may be synthesized by a reaction shown by the following formula (iii).

(2)

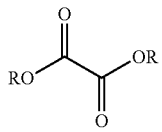

(Note that in the formula (2), R is the same as the above.)

(iii)

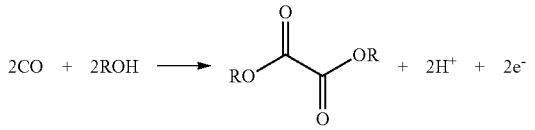

(Note that in the formula (iii), R is the same as the above.)

When ROH is represented by the general formula (1-1), an organic oxalate shown by the following formula (2-1) is formed by the reaction shown by the following formula (iv).

(2-1)

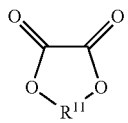

(Note that in the formula (2-1), $R^{11}$ is the same as the above.)

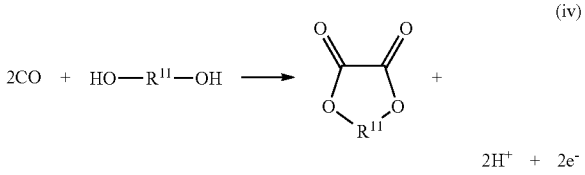

(iv)

(Note that in the formula (iv), $R^{11}$ is the same as the above.)

Specific preferable examples of the organic oxalate include one or more selected from the group consisting of dimethyl oxalate, diethyl oxalate, ethylene oxalate, dipropyl oxalate, propylene oxalate, diphenyl oxalate, ethyl methyl oxalate, methyl propyl oxalate, and ethyl propyl oxalate. Among them, the dimethyl oxalate is more preferable.

(Amine-Based Compound)

The amine-based compound used as the reactant is an organic compound having at least one amino group, and is preferably a compound represented by the following formula (3).

$$R^2NH_2 \quad (3)$$

($R^2$ represents an organic group having 1 to 15 carbon atoms.)

Examples of the organic group having 1 to 15 carbon atoms represented by $R^2$ in the above formula (3) include hydrocarbon groups having 1 to 15 carbon atoms, and the specific description thereof is the same as that of the hydrocarbon group in the above $R^1$.

In addition, the organic group having 1 to 15 carbon atoms in the formula (3) may contain a hetero atom such as a nitrogen atom, an oxygen atom, a sulfur atom or a phosphorus atom. Among them, a nitrogen atom is preferable, and the nitrogen atom is preferably a nitrogen atom of an amino group. Accordingly, it is preferable that $R^2$ be a hydrocarbon group having an amino group. More specifically, an aminoalkyl group having 1 to 15 carbon atoms is preferable.

When an amine-based compound is used as the reactant, a urea-based compound having a urea bond (—NH—CO—NH—) can be synthesized.

(Halogen)

When a target product is a carbonyl halide, a halogen may be used as the reactant. Examples of the halogen include chlorine and bromine. For information, when the halogen is chlorine, phosgene is obtained, and when the halogen is bromine, carbonyl bromide is obtained. In addition, in place of the halogen, a halogen may be formed by an electrochemical reaction in the electrochemical cell 10 from a metal halide salt which is used as the electrolyte. Accordingly, when a carbonyl halide is produced, the metal halide salt may be used as both of the reactant and the electrolyte (redox species).

[Solvent for Electrolyte Solution]

In a case where the above reactant is a solid or a gas, or in a case where it is necessary to improve the solubility of the redox species, or the like, the electrolyte solution may further contain a solvent (also referred to as a "solvent for electrolyte solution"). In this case, the electrolytic compartment may be filled with the reactant as a mixture with the solvent. Of course, even when the reactant is a liquid, the reactant may be filled as the mixture with the solvent.

The solvent for the electrolyte solution can be appropriately selected from the group consisting of solvents which are usually used in electrochemical reactions, and examples thereof include: nitril-based solvents such as acetonitrile; carbonate-based solvents such as ethylene carbonate, propylene carbonate, butylene carbonate, vinylene carbonate, dimethyl carbonate, ethyl methyl carbonate and diethyl carbonate; lactone-based solvents such as γ-butyrolactone; ether-based solvents such as 1,2-dimethoxyethane, 1-ethoxy-2-methoxyethane, 1,2-diethoxyethane, tetrahydrofuran and 2-methyl tetrahydrofuran; and a phosphate ester solvent, phosphoric acids, sulfolane-based solvents, and pyrrolidones. These solvents may be used singly, or two or more types thereof may be used in combination.

[Anode]

The anode 12 is an electrode which is used when the carbonyl compound is electrochemically synthesized from the carbon monoxide. The anode 12 converts a redox ion derived from a redox species from a reducing species to an oxidizing species, as described above, and thereby synthesizes a carbonyl compound from the carbon monoxide and the reactant, by the second catalyst and the oxidizing species in the electrolyte solution 13.

In the present embodiment, the anode 12 may not contain the second catalyst. In order to cause the anode to contain the catalyst, a step of causing the electrode to support the catalyst and the like are necessary as will be described in a second embodiment which will be described later. However, when the anode does not contain the catalyst, such a step becomes unnecessary, and accordingly the electrochemical cell can be configured simply.

Note that the second catalyst is a catalyst that catalyzes an electrochemical reaction which synthesizes a carbonyl compound from the carbon monoxide, as described above. In addition, the anode comes in contact with the electrolyte solution, and accordingly, in some cases the second catalyst contained in the electrolyte solution attaches to the anode; but an aspect in which the catalyst contained in the electrolyte solution simply attaches to the anode is not included in an aspect in which the catalyst is supported on the electrode, and accordingly is not included in an aspect in which "the anode contains the catalyst".

The anode includes, for example, an electrode substrate. The electrode substrate is not particularly limited, but the examples thereof include a carbon substrate, a metal substrate, and a metal oxide substrate; and it is preferable that the electrode substrate have electroconductivity. In addition, it is preferable that the substrate be a porous body. The substrate serves as a substrate which constitutes the electrode, and may have, for example, a sheet shape or a plate shape. Specific examples of the carbon substrate, the metal substrate and the metal oxide substrate are as shown as the above electrode substrate of the cathode. It is preferable for the electrode substrate which is used for the anode to be a carbon substrate, and is more preferable to be porous carbon. Specific examples of the porous carbon include a carbon non-woven fabric.

As described above, in the present embodiment, in the electrochemical cell 10, the carbon monoxide formed in the cathode 11 is not taken out from the electrolytic compartment 15, but is brought into contact with the reactant, the second catalyst and the oxidizing species which has been formed from the redox species on the anode 12, in the electrolyte solution 13; and thereby, the carbonyl compound can be synthesized in a simple configuration.

Specifically, the electrochemical cell can synthesize a carbonyl compound from a carbon monoxide in the inside of one electrolytic compartment 15 without providing an ion exchange membrane that partitions the cathode compartment from the anode compartment, or a connecting path that connects the cathode compartment and the anode compartment, and accordingly, the upsizing of the apparatus and the like also become easy.

In addition, in the present embodiment, the second catalyst, the first catalyst, the redox species and the like are appropriately selected, and the carbonyl compound can be synthesized from the carbon dioxide at a high selectivity.

Second Embodiment

Next, a second embodiment of the present invention will be described. In the first embodiment described above, the second catalyst is contained in the electrolyte solution, but in the second embodiment, the second catalyst is contained in the anode. Hereinafter, only the differences between the second embodiment and the first embodiment will be described.

The second catalyst sed in the second embodiment may be contained in the anode 12 by being supported on the electrode substrate that constitutes the anode 12. The second catalyst to be used in the second embodiment is as described in the above first embodiment, but preferably an active particle-containing catalyst is used. In addition, the second catalyst may be supported on the electrode substrate together with the catalyst additive.

The method for causing the electrode substrate to support the second catalyst, or the second catalyst and the catalyst additive (catalyst composition) thereon is not particularly limited, but is as described in the method for causing the electrode substrate to support the first catalyst thereon, and accordingly, the description thereof will be omitted.

Note that the catalyst may be supported on both surfaces of the electrode substrate and the catalyst layer may be provided on both surfaces of the second catalyst, similarly to the first catalyst, but the catalyst may be supported on only one surface. In addition, the anode 12 may be arranged so that the surface on which the catalyst is supported faces a cathode 11 side. Due to such an arrangement, the second catalyst results in being arranged between the cathode 11 and the anode 12, and it becomes easy to synthesize the carbonyl compound, as described in the first embodiment.

In the second embodiment, the second catalyst may be contained in the electrolyte solution as in the first embodiment, but may not be contained in the electrolyte solution. Note that the phrase "the second catalyst is not contained in the electrolyte solution" includes a mode in which the second catalyst is not contained substantially in the electrolyte solution, and in the case where the amount of the second catalyst supported on the anode is such an amount that the second catalyst is unintentionally mixed in the electrolyte solution, the case shall be a mode in which the second catalyst is not contained substantially in the electrolyte solution. For example, in the case where the second catalyst is contained in an amount of less than about 0.001 g per 1 L of the electrolyte solution, the second catalyst shall not be substantially contained in the electrolyte solution.

In the present embodiment, as shown in FIG. 1, carbon dioxide which has been supplied from the supply port 14 to the inside of the electrochemical cell 10 is reduced by the first catalyst in the cathode 11, and the carbon monoxide is formed. On the other hand, the anode 12 converts a redox ion from the reducing species to the oxidizing species, and also synthesizes a carbonyl compound from the carbon monoxide and the reactant in the presence of the oxidizing species, by the second catalyst.

Also, in the second embodiment described above, in the electrochemical cell 10, the carbon monoxide formed on the cathode 11 is not taken out from the electrolytic compartment 15, but is brought into contact with the reactant, the second catalyst, and the oxidizing species formed from the redox species on the anode 12, and thereby the carbonyl compound can be synthesized with a simple configuration.

In addition, in the present embodiment, when the second catalyst, the first catalyst, the redox species and the like are appropriately selected, it is thereby possible to synthesize the carbonyl compound from the carbon dioxide at a high selectivity, and when the second catalyst is supported on the anode 12, it is also possible to further improve the selectivity. In addition, when the second catalyst is supported on the anode 12, the amount of the second catalyst to be used can be suppressed even if the size is increased, which facilitates practical application.

Third Embodiment

Next, a third embodiment of the present invention will be described. In the first embodiment, the second catalyst is contained in the electrolyte solution, but in the third embodiment, a catalyst-supporting substrate 25 is further provided in the inside of the electrochemical cell 20, and the second catalyst is supported on the catalyst-supporting substrate 25.

The catalyst-supporting substrate 25 is not particularly limited as long as the substrate can support the second catalyst thereon, but is preferably a sheet-shaped or plate-shaped member. The catalyst-supporting substrate 25 may be a non-porous substrate or a porous substrate, but is preferably a porous substrate. The catalyst-supporting substrate 25 is a porous substrate, and thereby it becomes easy to support the second catalyst thereon. Examples of the porous substrate include a porous membrane having pores in the inside, a non-woven fabric, and a fibrous material, and among the above, a non-woven fabric is preferable.

The catalyst-supporting substrate 25 may be formed from an insulating material, and may be a resin substrate formed from a resin, for example. The resin substrate may be formed from a variety of resins which include, for example, polystyrene, polyethersulfone, an epoxy resin, polyphenylene sulfide, fluororesins such as PTFE, cellulose, polyamide, polyesters such as polyethylene terephthalate and polybutylene terephthalate, and polyolefins such as polyethylene and polypropylene. These resins may be used singly, or two or more types thereof may be used in combination. Among them, fluororesins are preferable.

The method for causing the catalyst-supporting substrate 25 to support the second catalyst thereon is not particularly limited, but includes the same method as the method for causing the electrode substrate to support the first catalyst thereon. Accordingly, also in the catalyst-supporting substrate 25, the catalyst may be supported on one surface, or the catalyst may be supported on both surfaces. In addition, the second catalyst may be supported on the catalyst-supporting substrate 25, together with the catalyst additive. The details of the case where the catalyst additive is used are the same as those in the case where the first catalyst or the second catalyst is supported on the electrode substrate together with the catalyst additive.

Figure 2:
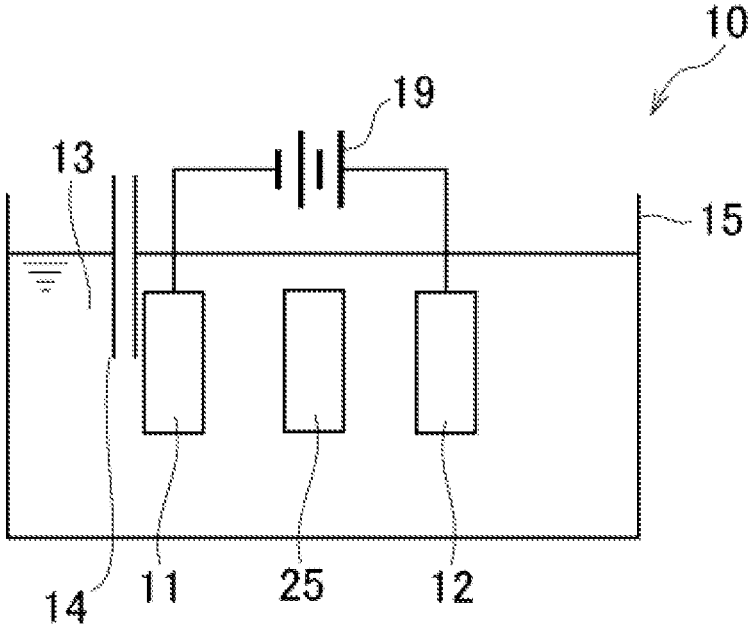
FIG. 2 shows a schematic view showing an electrochemical cell according to a third embodiment of the present invention.

In addition, the catalyst-supporting substrate 25 on which the second catalyst is supported is preferably arranged in the inner part of the electrolyte solution 13, as is shown in FIG. 2, but may be arranged in any form as long as the catalyst-supporting substrate 25 comes into contact with the electrolyte solution 13.

It is preferable that the catalyst-supporting substrate 25 be arranged between the cathode 11 and the anode 12. Thereby, it becomes easy for the reactant, the carbon monoxide formed on the cathode 11, and the oxidizing species converted on the anode 12 to come in contact with each other in the presence of the second catalyst, and to synthesize the carbonyl compound.

In the third embodiment, the second catalyst may be contained in the anode 12 as in the second embodiment, but may not be contained in the anode 12. In addition, the second catalyst may be contained in the electrolyte solution as in the first embodiment, but may not be contained in the electrolyte solution.

In the present embodiment, carbon dioxide which has been supplied from the supply port 14 to the inside of the electrochemical cell 10 is reduced by the first catalyst in the cathode 11, and the carbon monoxide is formed. On the other hand, the anode 12 converts the redox ion derived from the redox species, from the reducing species to the oxidizing species. Then, in the catalyst-supporting substrate 25, the second catalyst synthesizes a carbonyl compound from the carbon monoxide and the reactant, in the presence of the oxidizing species.

Also in the third embodiment described above, in the electrochemical cell 10, the carbon monoxide formed on the cathode 11 is not taken out from the electrolytic compartment 15, but is brought into contact with the reactant, the second catalyst, and the oxidizing species formed from the redox species on the anode 12, and thereby the carbonyl compound can be synthesized with a simple configuration.

In addition, when the second catalyst, the first catalyst, the redox species and the like are appropriately selected, it is thereby possible to synthesize the carbonyl compound from the carbon dioxide at a high selectivity, and when the second catalyst is supported on the catalyst-supporting substrate 25, it is also possible to further improve the selectivity. In addition, when the second catalyst is supported on the catalyst-supporting substrate 25, the amount of the second catalyst to be used can be suppressed even if the size is increased, which accordingly facilitates practical application.

In each of the above embodiments, the redox species has been used as the electrolyte in the electrolyte solution 13, but the electrolyte may contain an electrolyte other than the redox species, in addition to the redox species.

Examples of the electrolytes other than the redox species include perchlorates such as sodium perchlorate ($NaClO_4$), zinc perchlorate, barium perchlorate, lithium perchlorate and ammonium perchlorate; and sodium sulfate, potassium sulfate, and ammonium sulfate.

The electrolytes other than these redox species may be used singly, or two or more types thereof may be used in combination.

In addition, for example, in the second embodiment, the redox species may be omitted as the electrolyte, and the above electrolyte other than the redox species may be used, in place of the redox species. In the second embodiment, even when the electrolyte other than the redox species is used in place of the redox species, the carbonyl compound can be synthesized at a certain conversion rate.

Note that when the electrolyte other than the redox species is used in place of the redox species, the reaction of synthesizing the carbonyl compound from the carbon monoxide and the reactant is not performed in the presence of the oxidizing species. Accordingly, the second catalyst synthesizes the carbonyl compound from the carbon monoxide and the reactant, without the use of the oxidizing species.

EXAMPLES

The present invention will be described in more detail with reference to Examples, but the present invention is not limited to these Examples at all.

Example 1

(Preparation of Electrode)

In 50 ml of ethanol, 38.0 mg of poly(4-vinylpyridine) (P4VP, weight-average molecular weight of 60,000) was dispersed, and the dispersion liquid of P4VP was obtained. Into the dispersion liquid of P4VP, 1.8 ml of a solution (6.5 mg, Co=2 mg) of 20 mM $Co(II)(NO_3)_2$/ethanol, and 54 mg of Ketjhen Black ("ECP600JD", produced by LION Specialty Chemicals Co., Ltd.) were mixed, followed by drying to obtain a powder (raw material mixture for first catalyst). A cobalt content in the raw material mixture for first catalyst was 2% by mass. The obtained powder was sintered in an argon atmosphere at 200° C. for 3 hours, and a first catalyst was obtained.

A dispersion liquid was prepared by mixing 8 mg of the first catalyst with 40 μL of a dispersion liquid of 10% by mass of a catalyst additive, and dispersing the mixture in 400 μL of acetone, and the resultant was applied to carbon paper ("29BC" produced by Sumisho Global Logistics Co., Ltd.) which was heated to 40° C., and the applied liquid was dried, and a cathode (CoP4VP/carbon) was obtained on which the first catalyst was supported.

The above carbon paper on which the catalyst was not supported was used as an anode.

In each of Examples and Comparative Examples, "Nafion" was used as the catalyst additive. In addition, in each of Examples, a content of the catalyst additive with respect to the total amount of the catalyst and the catalyst additive (in other words, the catalyst composition) was adjusted so as to become 33% by mass.

(Preparation of Electrochemical Cell)

Subsequently, 60 mg of $Pd(NO_3)_2 \cdot 2H_2O$ (produced by Sigma-Aldrich) and 60 mg of Ketjhen black (product name "EC-300J" (Fuel Cell Store), BET specific surface area of 800 $m^2/g$, and average primary particle size of 40 nm) were dispersed in 50 ml of ion-exchanged water, then the resultant was dried, and subsequently, the dried product was heated at 300° C. for 1 hour to obtain a second catalyst (Pd—C).

Next, a cathode and an anode were placed in a single-compartment typed electrochemical cell; and the electrochemical cell was filled with a methanol solution of 0.1 M LiBr, and then 30 mg of the second catalyst was dispersed.

Into the electrochemical cell, $CO_2$ (1 atm) was supplied, and 12 mA was passed between the anode and the cathode to cause a reaction; then, the components of the reaction liquid were analyzed by gas chromatography; and the selectivity of each carbonyl compound was calculated based on the comparison with the current value. The selectivity was calculated for an organic carbonate and an organic oxalate. The results are shown in Table 1.

Example 2

The same procedures as in Example 1 were implemented, except that an ethanol solution of 0.1 M LiBr was used in place of the methanol solution of 0.1 M LiBr, in the electrochemical cell.

Example 3

The same procedures as in Example 1 were implemented, except that a phenol/acetonitrile (50 vol/50 vol) mixture solution of 0.1 M LiBr was used in place of the methanol solution of 0.1 M LiBr, in the electrochemical cell.

Example 4

The same procedures as in Example 1 were implemented, except that a methanol solution of 0.1 M NaBr was used in place of the methanol solution of 0.1 M LiBr in the electrochemical cell.

Example 5

The same procedures as in Example 1 were implemented, except that a methanol solution of 0.1 M KBr was used in place of the methanol solution of 0.1 M LiBr in the electrochemical cell.

Example 6

$HAuCl_4 \cdot 3H_2O$ (produced by Sigma-Aldrich) in an amount of 30 mg and Ketjhen Black in an amount of 40 mg were dispersed in 50 ml of ion-exchanged water, the dispersion liquid was dried, then, the dried product was heated at 300° C. for 1 hour, and the second catalyst was obtained. As for other conditions, the same procedures as in Example 4 were implemented, and the selectivity was calculated. The results are shown in Table 1.

Example 7

$Pd(NO_3)_2 \cdot 2H_2O$ (produced by Aldrich) in an amount of 25 mg, $HAuCl_4.3H_2O$ (produced by Sigma-Aldrich) in an amount of 37 mg, and Ketjhen Black in an amount of 75 mg were dispersed in 50 ml of ion-exchanged water, the dispersion liquid was dried, then, the dried product was heated at 300° C. for 2 hours, and the second catalyst (PdAu—C) was obtained. In the second catalyst, a molar ratio of Pd to Au was 50:50. After that, the same procedures as in Example 4 were implemented, and the selectivity was calculated. The results are shown in Table 1.

Example 8

The same procedures as in Example 4 were implemented, except that the second catalyst (Pd—C) was supported on the anode, in place of being dispersed in the electrolyte solution. The anode on which the second catalyst was supported was obtained by mixing 8 mg of the second catalyst and 40 μL of a dispersion liquid of 10% by mass of a catalyst additive, dispersing the mixture in 400 μL of acetone, and applying the mixture onto carbon paper ("29BC" produced by Sumisho Global Logistics Co., Ltd.) which was heated to 40° C.

Example 9

The same procedures as in Example 4 were implemented, except that a catalyst-supporting substrate was further prepared, and the second catalyst (Pd—C) was supported on the catalyst-supporting substrate, in place of being dispersed in the electrolyte solution. In addition, the catalyst-supporting substrate on which the second catalyst was supported was obtained by mixing 8 mg of the second catalyst and 40 μL of a dispersion liquid of 10% by mass of a catalyst additive, dispersing the mixture in 400 μL of acetone, and applying the mixture onto a Teflon sheet ("PTFE0247" produced by MTI Corporation) which was a porous body and was heated to 40° C. In the electrochemical cell, the catalyst-supporting substrate was arranged between the anode and the cathode.

Examples 10 and 11

$HAuCl_4 \cdot 3H_2O$ (produced by Sigma-Aldrich) in an amount of 30 mg and Ketjhen Black in an amount of 60 mg were dispersed in 50 ml of ion-exchanged water, then, the dispersion liquid was dried, after that, the dried product was heated at 300° C. for 0.5 hours, and the first catalyst (Au/carbon) was obtained in which nano gold particles were supported on carbon black. A cathode on which a first catalyst is supported was obtained in the same method as in Example 1, except that the obtained first catalyst was used in place of the first catalyst prepared in Example 1. The same procedures as in Examples 8 and 9 were implemented, except that the obtained cathode was used in place of the cathode on which the first catalyst (CoP4VP/carbon) was supported.

Examples 12 and 13

A second catalyst (PdAu—C) was obtained in the same manner as in Example 7. The same procedures as in Examples 8 and 9 were implemented, except that the obtained second catalyst (PdAu—C) was used in place of the second catalyst (Pd—C).

Comparative Example 1

The same procedures as in Example 1 were implemented, except that the second catalyst dispersed in the reactant was omitted.

Comparative Example 2

The same procedures as in Example 1 were implemented, except that LiBr was omitted which was added to the reactant and the first catalyst was omitted which was supported on the cathode.

TABLE 1

| | | Structure | | | | Product | | | |
|---|---|---|---|---|---|---|---|---|---|
| | Reactant | Cathode | Anode | Second catalyst | Electrolyte | Product | Selectivity (%) | Product | Selectivity (%) |
| Example 1 | MeOH | CoP4VP/Carbon | Carbon | Pd-C (dispersed) | LiBr | DMC | 30 | DMO | 12 |
| Example 2 | EtOH | CoP4VP/Carbon | Carbon | Pd-C (dispersed) | LiBr | DEC | 24 | DEO | 7 |
| Example 3 | PhOH | CoP4VP/Carbon | Carbon | Pd-C (dispersed) | LiBr | DPhC | 21 | — | — |
| Example 4 | MeOH | CoP4VP/Carbon | Carbon | Pd-C (dispersed) | NaBr | DMC | 45 | DMO | 10 |
| Example 5 | MeOH | CoP4VP/Carbon | Carbon | Pd-C (dispersed) | KBr | DMC | 38 | DMO | 9 |
| Example 6 | MeOH | CoP4VP/Carbon | Carbon | Au-C (dispersed) | NaBr | DMC | 15 | DMO | 31 |
| Example 7 | MeOH | CoP4VP/Carbon | Carbon | PdAu-C (dispersed) | NaBr | DMC | 51 | DMO | 6 |

TABLE 1-continued

| | | Structure | | | | Product | | | |
|---|---|---|---|---|---|---|---|---|---|
| | Reactant | Cathode | Anode | Second catalyst | Electrolyte | Product | Selectivity (%) | Product | Selectivity (%) |
| Example 8 | MeOH | CoP4VP/Carbon | Carbon | Pd-C (supported on anode) | NaBr | DMC | 60 | DMO | 7 |
| Example 9 | MeOH | CoP4VP/Carbon | Carbon | Pd-C (supported on catalyst substrate) | NaBr | DMC | 65 | DMO | 5 |
| Example 10 | MeOH | Au/Carbon | Carbon | Pd-C (supported on anode) | NaBr | DMC | 45 | DMO | 11 |
| Example 11 | MeOH | Au/Carbon | Carbon | Pd-C (supported on catalyst substrate) | NaBr | DMC | 48 | DMO | 9 |
| Example 12 | MeOH | CoP4VP/Carbon | Carbon | PdAu-C (supported on anode) | NaBr | DMC | 68 | DMO | 5 |
| Example 13 | MeOH | CoP4VP/Carbon | Carbon | PdAu-C (supported on catalyst substrate) | NaBr | DMC | 70 | DMO | 3 |
| Comparative Example 1 | MeOH | CoP4VP/Carbon | Carbon | — | LiBr | DMC | 0 | DMO | 0 |
| Comparative Example 2 | MeOH | Carbon | Carbon | Pd-C (dispersed) | — | DMC | 0 | DMO | 0 |

DMC = dimethyl carbonate
DEC = diethyl carbonate
DPhC = diphenyl carbonate
DMO = dimethyl oxalate
DEO = diethyl oxalate As shown in Table 1, in Examples 1 to 7, the first catalyst was supported on the cathode, and the reactant, the electrolyte and the second catalyst were contained in the electrolyte solution; and thereby, the carbonyl compound could be synthesized from carbon dioxide at a high selectivity. In Examples 8, 10 and 12, the first catalyst was supported on the cathode, the second catalyst was supported on the anode, and the reactant and the electrolyte were contained in the electrolyte solution; and thereby, the carbonyl compound could be synthesized from carbon dioxide at a high selectivity. Furthermore, in Examples 9, 11 and 13, the first catalyst was supported on the cathode, the second catalyst was supported on the catalyst-supporting substrate which was provided separately from the electrode, and the reactant and the electrolyte were contained in the electrolyte solution; and thereby, the carbonyl compound could be synthesized from carbon dioxide at a high selectivity.

On the other hand, in Comparative Examples 1 and 2, at least one of the first catalyst, the second catalyst and the electrolyte was not used, and accordingly the carbonyl compound could not be synthesized from carbon dioxide at a high selectivity.

REFERENCE SIGNS LIST

10 electrochemical cell
11 cathode
12 anode
13 electrolyte solution
14 supply port
15 electrolytic compartment
19 power source
25 catalyst-supporting substrate

The invention claimed is:

1. An electrochemical cell comprising:

a cathode having a first catalyst that reduces carbon dioxide to carbon monoxide;

an anode;

an electrolyte solution containing a reactant and an electrolyte; and a second catalyst that synthesizes a carbonyl compound from the carbon monoxide and the reactant, wherein the electrolyte comprises a redox ion;

the anode converts the redox ion into an oxidizing species;

the second catalyst synthesizes the carbonyl compound from the carbon monoxide and the reactant in the presence of the oxidizing species;

the electrochemical cell is a single-compartment type, and the electrolyte solution filled in the electrolytic compartment of the electrochemical cell comes in contact with the cathode, the anode and the second catalyst at least;

the second catalyst is an active particle-containing catalyst that is powdery or particulate;

the active particle-containing catalyst is dispersed in the electrolyte solution and contains a support and active particles having a metal element that are supported on the support; and the support is porous carbon.

2. The electrochemical cell according to claim 1, wherein the redox ion is a halogen ion.

3. The electrochemical cell according to claim 1, wherein the second catalyst comprises a metal element selected from the group consisting of elements of Group 8 to Group 11.

4. The electrochemical cell according to claim 1, wherein the second catalyst comprises Pd.

5. The electrochemical cell according to claim 1, wherein the anode comprises an electrode substrate, and the electrochemical cell further comprises another catalyst that synthesizes a carbonyl compound from the carbon monoxide and the reactant, and the another catalyst is supported on the electrode substrate.

6. The electrochemical cell according to claim 1, further comprising a catalyst-supporting substrate that is at least one selected from the group consisting of a sheet-shaped member and a plate-shaped member; and another catalyst that synthesizes a carbonyl compound from the carbon monoxide and the reactant, and the another catalyst is supported by the catalyst-supporting substrate.

7. The electrochemical cell according to claim 1, wherein the second catalyst is arranged between the cathode and the anode.

8. The electrochemical cell according to claim 1, wherein the first catalyst comprises a metal element of the Group 7 to Group 12.

9. The electrochemical cell according to claim 1, wherein the first catalyst comprises CoO and a component derived from a pyridine derivative.

10. The electrochemical cell according to claim 1, wherein the reactant is an alcohol-based compound.

11. The electrochemical cell according to claim 1, wherein the anode does not contain the second catalyst.

12. An electrochemical cell comprising:

a cathode having a first catalyst that reduces carbon dioxide to carbon monoxide;

an anode;

an electrolyte solution containing a reactant and an electrolyte; and a second catalyst that synthesizes a carbonyl compound from the carbon monoxide and the reactant, wherein the electrolyte comprises a redox ion;

the anode converts the redox ion into an oxidizing species;

the second catalyst synthesizes the carbonyl compound from the carbon monoxide and the reactant in the presence of the oxidizing species;

the electrochemical cell is a single-compartment type, and the electrolyte solution filled in the electrolytic compartment of the electrochemical cell comes in contact with the cathode, the anode and the second catalyst at least;

the electrochemical cell further comprises a catalyst-supporting substrate that supports the second catalyst, and the catalyst-supporting substrate is formed from an insulating material; and the catalyst-supporting substrate is at least one selected from the group consisting of a sheet-shaped member and a plate-shaped member.

13. The electrochemical cell according to claim 12, wherein the catalyst-supporting substrate is a porous substrate.

14. The electrochemical cell according to claim 13, wherein the porous substrate is at least one selected from the group consisting of a porous membrane, a non-woven fabric, and a fibrous material.

15. The electrochemical cell according to claim 12, wherein the catalyst-supporting substrate is other than the cathode and the anode.

16. The electrochemical cell according to claim 12, wherein the second catalyst is an active particle-containing catalyst that is powdery or particulate, and the active particle-containing catalyst contains a support and active particles having a metal element that are supported on the support.

17. The electrochemical cell according to claim 12, wherein the catalyst-supporting substrate is a resin substrate, and a resin in the resin substrate is at least one selected from the group consisting of polystyrene, polyethersulfone, epoxy resin, polyphenylene sulfide, fluororesin, cellulose, polyamide, polyester and polyolefin.

18. The electrochemical cell according to claim 12, wherein the catalyst-supporting substrate is a resin substrate, and a resin in the resin substrate is at least one selected from the group consisting of fluororesin and polyolefin.

* * * * *